US009856072B1

(12) United States Patent
Clark et al.

(10) Patent No.: US 9,856,072 B1
(45) **Date of Patent: *Jan. 2, 2018**

(54) SYSTEM FOR MIXING AND DISPENSING FLUIDS

(71) Applicant: Decon7 Systems, LLC, Scottsdale, AZ (US)

(72) Inventors: Mark R. Clark, Portland, OR (US); Meggie L. Oudheusden, Philadelphia, PA (US); Matthew A. Bluhm, Winnetka, IL (US); Joseph R. Drake, Scottsdale, AZ (US); Thomas William Murray, Philadelphia, PA (US); Jonathan D. Albert, Philadelphia, PA (US)

(73) Assignee: Decon7 Systems, LLC, Scottsdale, AZ (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/394,591

(22) Filed: Dec. 29, 2016

Related U.S. Application Data

(63) Continuation-in-part of application No. 29/573,185, filed on Aug. 3, 2016.

(51) Int. Cl.
*B65D 83/68* (2006.01)
*B65D 25/28* (2006.01)
(Continued)

(52) U.S. Cl.
CPC ..... *B65D 83/682* (2013.01); *B65D 25/2894* (2013.01); *B65D 25/40* (2013.01); *B65D 83/202* (2013.01); *B65D 83/226* (2013.01)

(58) Field of Classification Search
CPC ..... B05B 7/0408; B05B 7/2472; B05B 7/26; B05B 11/0078; B05B 11/0081;
(Continued)

(56) References Cited

U.S. PATENT DOCUMENTS 3,303,970 A * 2/1967 Breslau ..... B65D 83/202 137/607
3,506,159 A * 4/1970 Muller ..... B65D 83/202 222/135
(Continued)

FOREIGN PATENT DOCUMENTS

EP 0734781 A1 10/1996
WO 9920543 4/1999

*Primary Examiner* — Arthur O Hall
*Assistant Examiner* — Cody Lieuwen
(74) *Attorney, Agent, or Firm* — Loeb & Loeb, LLP

(57) ABSTRACT

A mixing and dispensing device comprising an outer casing including a body portion, a handle portion, and a nozzle portion with a nozzle. A mixing manifold disposed in the body portion including a mixing chamber in fluid communication with the nozzle. Canisters within the body portion each including a valve connected to the mixing manifold movable between preventing and providing fluid communication between the canister and the mixing chamber. A trigger disposed within the handle portion and configured to move from a trigger passive to dispensing position causing the valves of each canister to move from a valve passive position to the valve dispensing position. A pull safety including a central cover and a tail tip removably disposed on the outer casing such that the central cover occludes the nozzle and the tail tip prevents movement of the trigger from the trigger passive position to the trigger dispensing position.

16 Claims, 20 Drawing Sheets

(51) Int. Cl.
*B65D 25/40* (2006.01)
*B65D 83/22* (2006.01)
*B65D 83/20* (2006.01)

(58) Field of Classification Search
CPC ..... B05B 11/3081; B05B 11/3084; B05B 12/002; B05B 12/1418; B65D 83/202; B65D 83/224; B65D 83/226; B65D 83/68; B65D 83/682; B65D 83/7538; B65D 83/757; B65D 83/7575
USPC .... 239/304, 353, 375, 414, 416.1, 428, 526, 239/527; 222/129, 145.1, 145.5, 222/402.1–402.25, 465.1, 470, 472
See application file for complete search history.

(56) References Cited

U.S. PATENT DOCUMENTS 3,608,782 A 9/1971 Sethleq
3,760,986 A 9/1973 Castner et al.
4,460,711 A 7/1984 Jacobson
4,505,335 A * 3/1985 Hayba ..... A62C 13/62 169/76
4,880,143 A 11/1989 Murray et al.
5,152,461 A 10/1992 Proctor
5,899,362 A 5/1999 Moran
D484,038 S 12/2003 Santiago et al.
7,021,499 B2 4/2006 Hansen et al.
7,216,783 B2 5/2007 Hansen
7,750,199 B1 7/2010 Tucker
7,906,473 B2 3/2011 Williams et al.
7,967,220 B2 6/2011 Hansen et al.
8,328,118 B2 12/2012 Hansen et al.
8,338,354 B2 12/2012 Williams et al.
8,784,504 B2 7/2014 Williams et al.
2004/0063600 A1* 4/2004 Williams ..... A47L 13/00 510/375
2007/0272766 A1* 11/2007 Tryon ..... B05B 1/1654 239/337
2010/0025437 A1* 2/2010 Oshimo ..... B65D 83/24 222/402.13
2012/0080455 A1* 4/2012 Jug ..... B65D 83/202 222/402.15
2013/0284767 A1* 10/2013 Strand ..... B05B 11/3057 222/402.13
2016/0083172 A1* 3/2016 Ogata ..... B65D 83/206 222/394

* cited by examiner

SYSTEM FOR MIXING AND DISPENSING FLUIDS

CROSS-REFERENCE TO RELATED APPLICATIONS

This application claims priority to U.S. Design patent application No. 29/573,185, filed Aug. 3, 2016, the entirety of which is incorporated by reference herein.

TECHNICAL FIELD

The present disclosure relates generally to the field of mixing and dispensing materials and, more specifically, to combining a plurality of materials for substantially simultaneous dispensing from a nozzle.

BACKGROUND

The background description provided herein is for the purpose of generally presenting the context of the disclosure. Work of the presently named inventors, to the extent it is described in this background section, as well as aspects of the description that may not otherwise qualify as prior art at the time of filing, are neither expressly nor impliedly admitted as prior art against the present disclosure.

People working in a variety of fields risk encountering hazardous or contaminated materials that require cleaning or decontamination. Examples include first responders to natural or man-made disasters, bio-hazard clean-up crews, law enforcement officers, military personnel, fire fighters, and others. For those working in these fields, tools for dealing with hazards should be easy to use and reliable so that workers can do their jobs without undue complications or inefficiency. A tool is needed for quickly addressing the cleaning or decontamination of hazardous materials that is intuitive to use and reliable even in the most chaotic conditions.

SUMMARY

Features and advantages described in this summary and the following detailed description are not all-inclusive. Many additional features and advantages will be apparent to one of ordinary skill in the art in view of the drawings, specification, and claims hereof. Additionally, other embodiments may omit one or more (or all) of the features and advantages described in this summary.

The disclosed device may be used to combine and dispense a plurality of materials in a precise mixture throughout a spray cycle. In some embodiments, the disclosed device may include three separate materials that may be combined on demand to provide a spray pattern with a desired mixture upon dispensing from the devise. The resulting spray may be used for various applications, such as hazardous material decontamination or more general cleaning purposes.

In an embodiment, the disclosure describes a mixing and dispensing device comprising an outer casing including a body portion, a handle portion, and a nozzle portion, wherein the handle portion is connected to a top portion of the body portion and the nozzle portion includes a nozzle. The device includes a mixing manifold disposed in the top portion of the body portion. The mixing manifold may include a mixing chamber in fluid communication with the nozzle. The device may include a plurality of canisters disposed within the body portion. Each of the plurality of canisters may include a valve connected to the mixing manifold. The valve may be movable between a valve passive position, in which the valve prevents fluid communication between an interior of the canister and the mixing chamber, and a valve dispensing position, in which the valve provides fluid communication between the interior of the canister and the mixing chamber. The device may include a trigger including a trigger input and a trigger output. The trigger may be at least partially disposed within the handle portion, and the trigger may be configured to move from a trigger passive position to a trigger dispensing position causing the valve each canister to move from the valve passive position to the valve dispensing position. The device may include a pull safety with a central cover and a tail tip. The pull safety may be removably disposed on the outer casing such that the central cover occludes the nozzle and the tail tip prevents movement of the trigger from the trigger passive position to the trigger dispensing position.

In another embodiment, the disclosure describes a mixing and dispensing device comprising an outer casing including a body portion, a handle portion, and a nozzle portion, wherein the handle portion is connected to a top portion of the body portion and the nozzle portion includes a nozzle. The device may include a trigger including a trigger input and a trigger output. The trigger may be at least partially disposed within the handle portion, and the trigger may be configured to move between a trigger passive position and a trigger dispensing position. The device may include a cam component disposed in the top portion of the body portion. The cam component may be configured to be engaged by the trigger output to move the cam component along a first axis from a cam component passive position to a cam component dispensing position when the trigger moves from the trigger passive position to the trigger dispensing position. The device may include a mixing manifold disposed in the top portion of the body portion, the mixing manifold including a mixing chamber in fluid communication with the nozzle. The mixing manifold may be in communication with the cam component such that movement of the cam component along the first axis from the cam component passive position to the cam component dispensing position causes movement of the mixing manifold along a second axis from a manifold passive position to a manifold dispensing position. The device may include at least one canister disposed within the body portion. Each of the at least one canister may include a valve connected to the mixing manifold. The valve may be movable between a valve passive position, in which the valve prevents fluid communication between an interior of the respective canister and the mixing chamber, and a valve dispensing position, in which the valve provides fluid communication between the interior of the respective canister and the mixing chamber. Movement of the trigger from the trigger passive position to the trigger dispensing position may result in fluid communication between the interior of the at least one canister, the mixing chamber, and the nozzle.

In another embodiment, the disclosure describes a mixing and dispensing device comprising an outer casing including a body portion, a handle portion, and a nozzle portion, wherein the handle portion is connected to a top portion of the body portion and the nozzle portion includes a nozzle. The device may include a trigger including a trigger input and a trigger output. The trigger may be at least partially disposed within the handle portion, and the trigger may be configured to move between a trigger passive position and a trigger dispensing position. The device may include a cam component disposed in the top portion of the body portion. The cam component may be configured to be engaged by the trigger output to move the cam component along a first axis from a cam component passive position to a cam component dispensing position when the trigger moves from the trigger passive position to the trigger dispensing position. The device may include a mixing manifold disposed in the top portion of the body portion. The mixing manifold may include a mixing chamber in fluid communication with the nozzle. The mixing manifold may be in communication with the cam component such that movement of the cam component along the first axis from the cam component passive position to the cam component dispensing position causes movement of the mixing manifold along a second axis from a manifold passive position to a manifold dispensing position. The device may include a plurality of canisters disposed within the body portion. Each of the plurality of canisters may include a valve connected to the mixing manifold. The valve may be movable between a valve passive position, in which the valve prevents fluid communication between an interior of the respective canister and the mixing chamber, and a valve dispensing position, in which the valve provides fluid communication between the interior of the respective canister and the mixing chamber. The device may include a pull safety including a central cover and a tail tip. The pull safety may be removably disposed on the outer casing such that the central cover occludes the nozzle and the tail tip prevents movement of the trigger from the trigger passive position to the trigger dispensing position. The removal of the pull safety from the outer casing may allow movement of the trigger from the trigger passive position to the trigger dispensing position, which results simultaneous fluid communication between the interior of each of the plurality of canisters, the mixing chamber, and the nozzle.

BRIEF DESCRIPTION OF THE DRAWINGS

Non-limiting and non-exhaustive embodiments are described in reference to the following drawings. In the drawings, like reference numerals refer to like parts through all the various figures unless otherwise specified.

For a better understanding of the present disclosure, a reference will be made to the following detailed description, which is to be read in association with the accompanying drawings, wherein.

Figure 1:
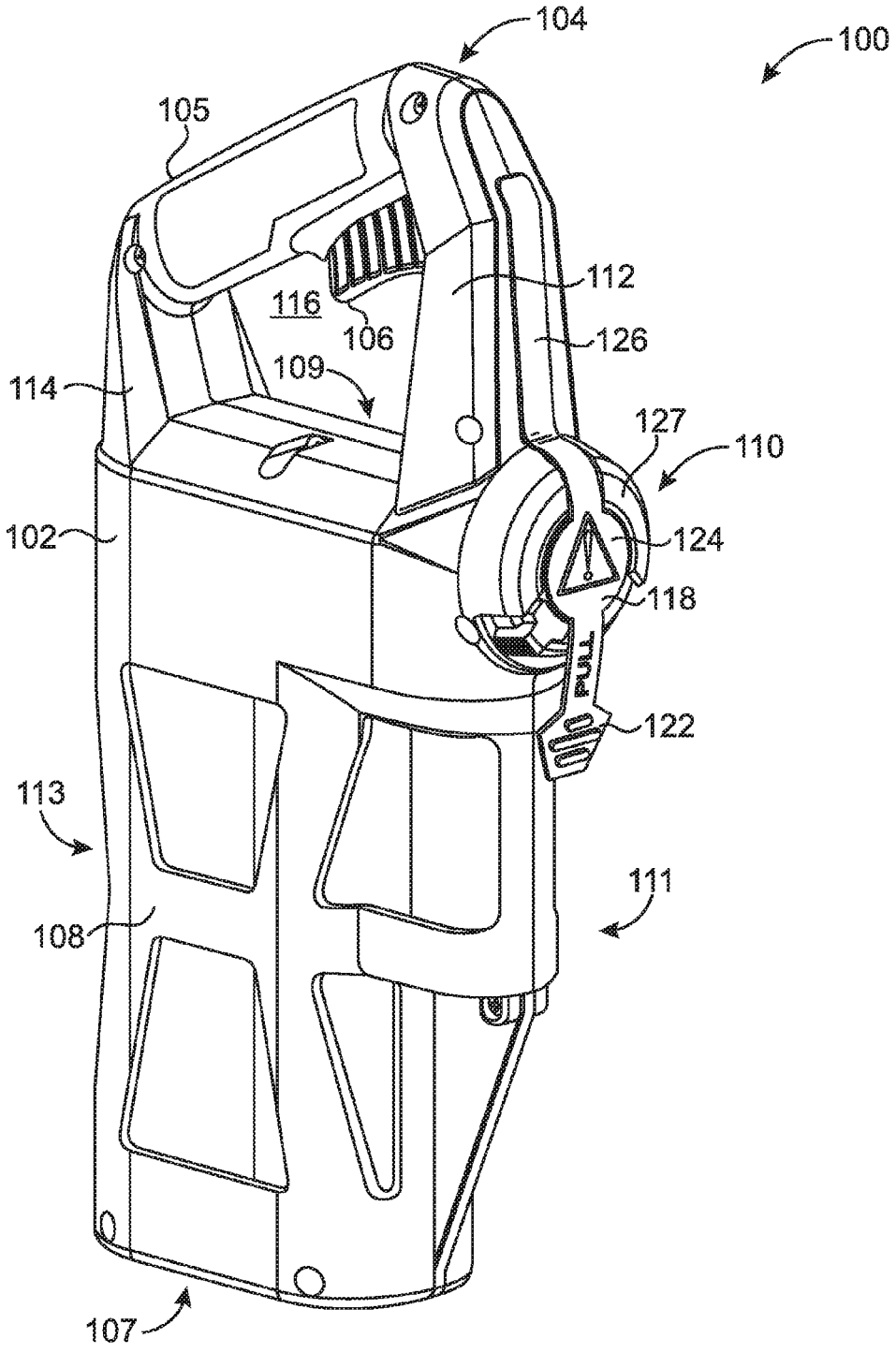
FIG. 1 shows a perspective view of an embodiment of a decontamination device, as shown and described herein.
Figure 2:
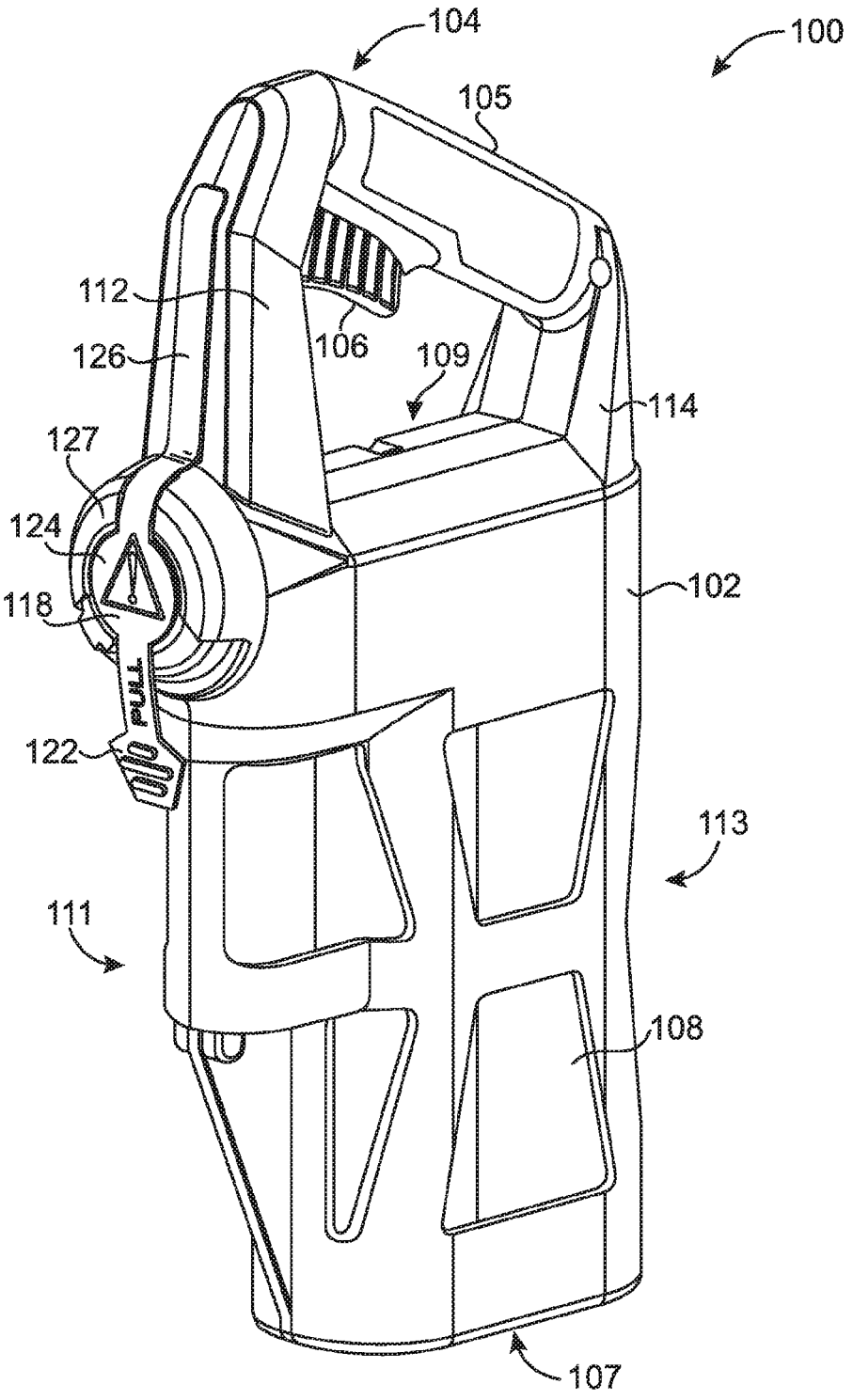
FIG. 2 shows another perspective view of the decontamination device of FIG. 1.
Figure 3:
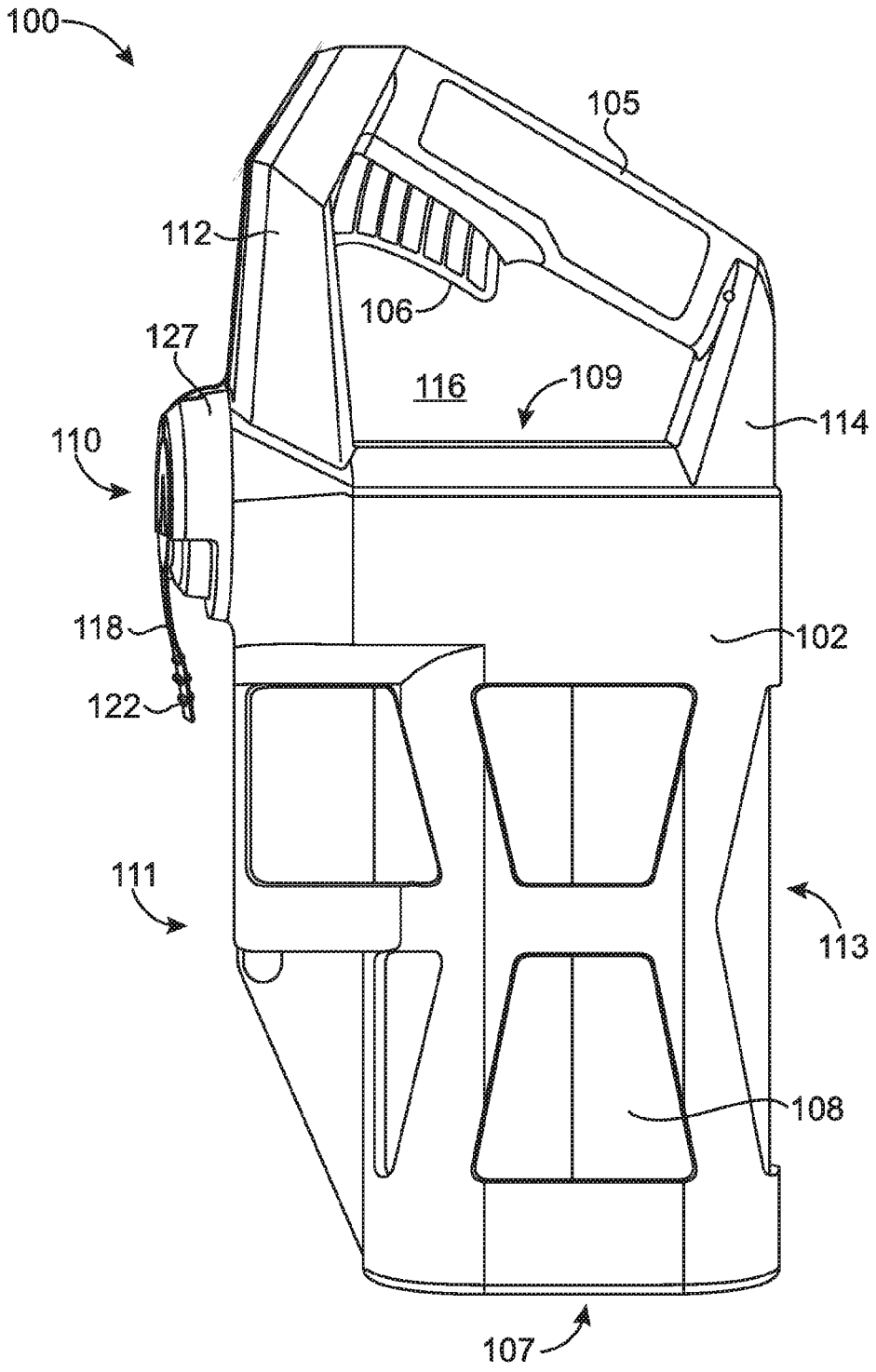
FIG. 3 shows a right side view of the decontamination device of FIG. 1.
Figure 4:
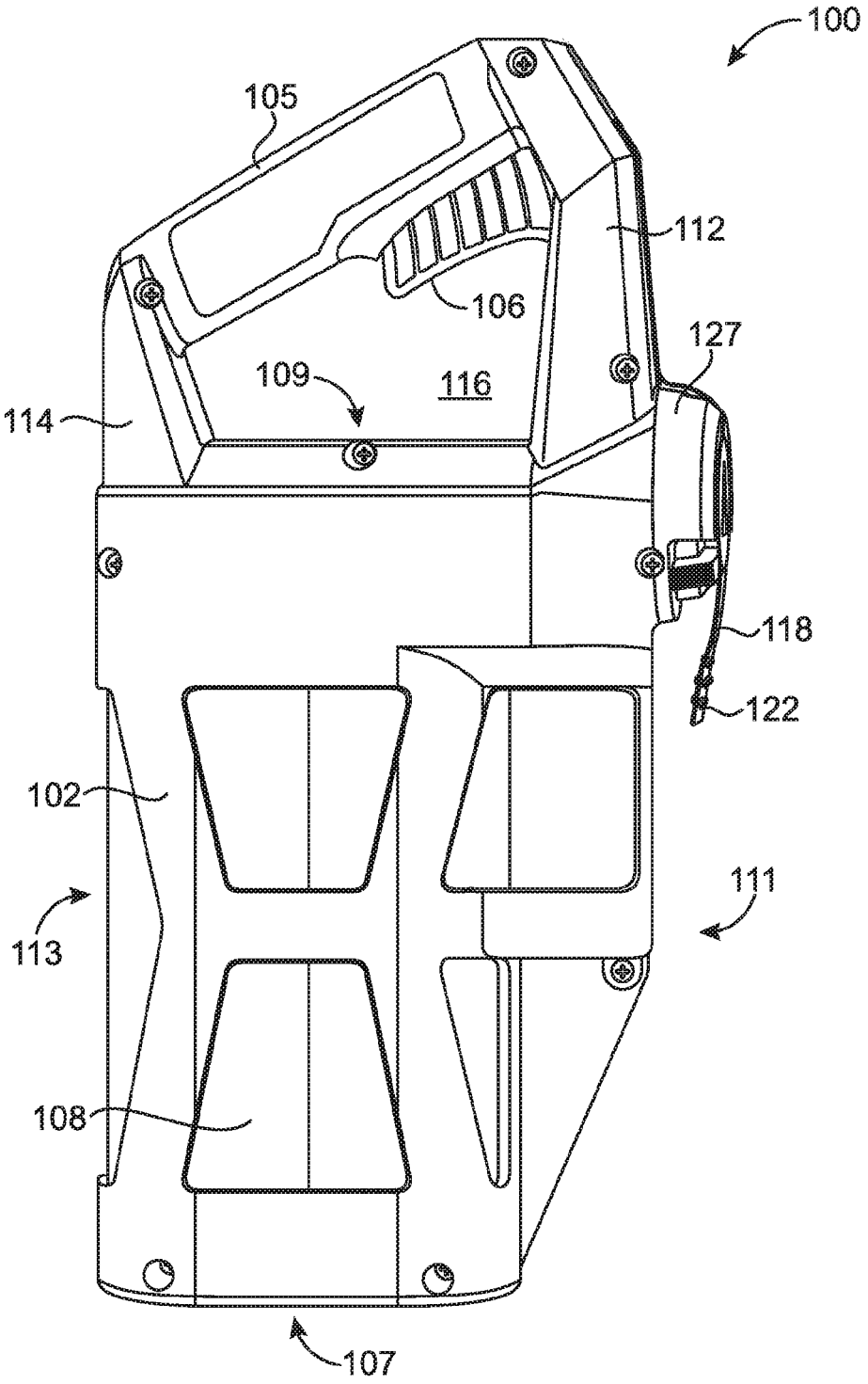
FIG. 4 shows a left side view decontamination device of FIG. 1.
Figure 5:
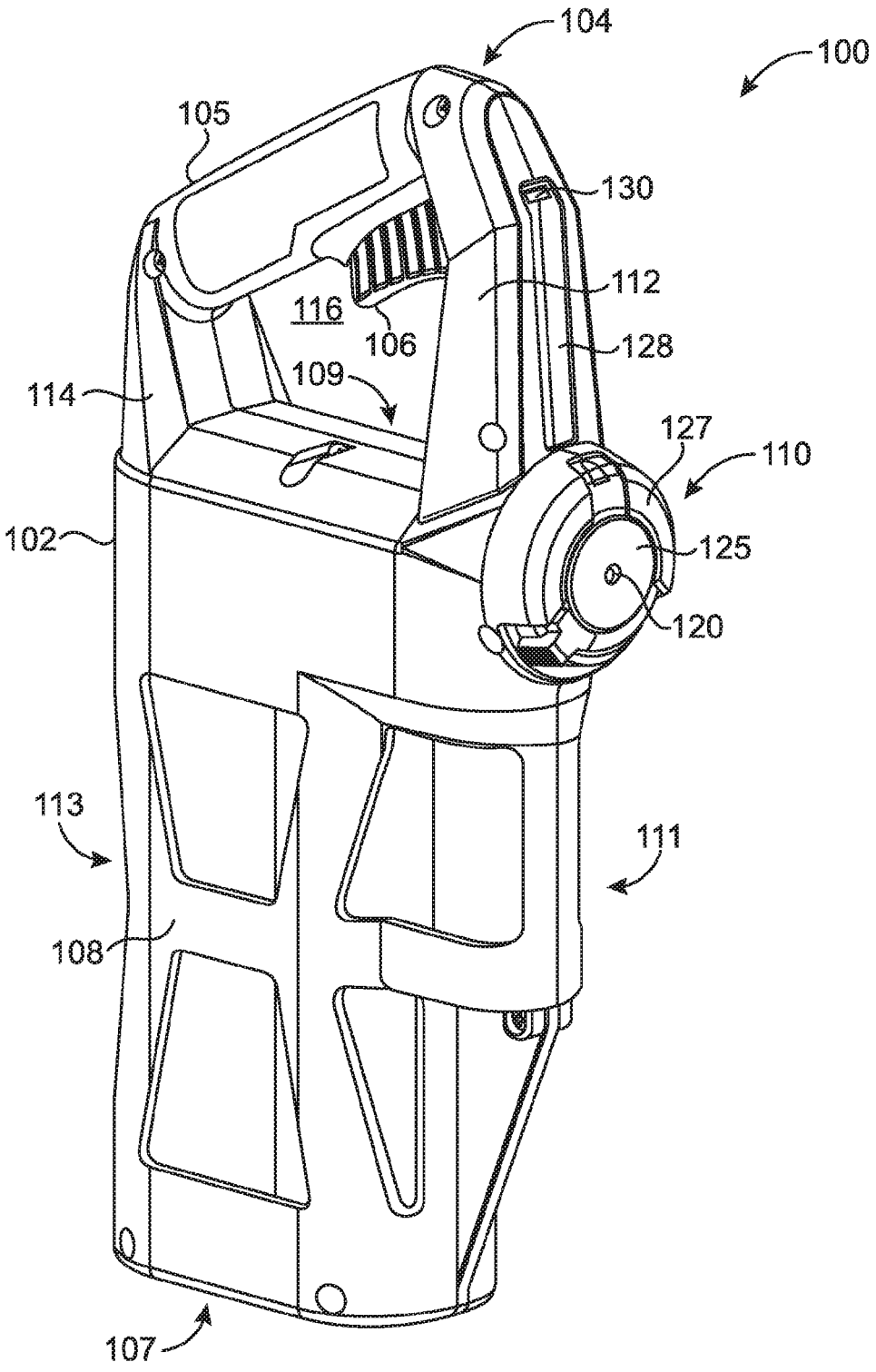
FIG. 5 shows a perspective view of the decontamination device of FIG. 1 with a pull safety removed.

One skilled in the art may readily recognize from the following discussion that alternative embodiments of the structures and methods illustrated herein may be employed without departing from the principles described herein.

DETAILED DESCRIPTION

The present invention now will be described more fully hereinafter with reference to the accompanying drawings, which form a part hereof, and which show, by way of illustration, specific exemplary embodiments by which the invention may be practiced. This invention may, however, be embodied in many different forms and should not be construed as limited to the embodiments set forth herein; rather, these embodiments are provided so that this disclosure will be thorough and complete, and will fully convey the scope of the invention to those skilled in the art. Among other things, the present invention may be embodied as methods or devices. Accordingly, the present invention may take the form of an entirely hardware embodiment, an entirely software embodiment or an embodiment combining software and hardware aspects. The following detailed description is, therefore, not to be taken in a limiting sense.

Throughout the specification and claims, the following terms take the meanings explicitly associated herein, unless the context clearly dictates otherwise. The phrase "in one embodiment" as used herein does not necessarily refer to the same embodiment, although it may. Furthermore, the phrase "in another embodiment" as used herein does not necessarily refer to a different embodiment, although it may. Thus, as described below, various embodiments of the invention may be readily combined, without departing from the scope or spirit of the invention.

In addition, as used herein, the term "or" is an inclusive "or" operator, and is equivalent to the term "and/or," unless the context clearly dictates otherwise. The term "based on" is not exclusive and allows for being based on additional factors not described, unless the context clearly dictates otherwise. In addition, throughout the specification, the meaning of "a," "an," and "the" include plural references.

The meaning of "in" includes "in" and includes plural references. The meaning of "in" includes "in" and "on."

The present disclosure relates to a system and method for mixing and dispensing fluids. More specifically, the present disclosure relates methods and systems for quick-response decontamination, but is not limited to such uses. In some embodiments, the disclosed systems and methods may provide precise mixing of two or more materials (e.g. fluid components), selectable spray types to dispense the mixed fluid materials (e.g. stream, course wet spray), and ergonomic shape and trigger position to aide in activating mixing and dispensing.

In some embodiments, the disclosed device may be used to dispense quick-response decontamination spray. In such embodiments, a user may pull or otherwise activate a trigger, which may cause the device to mix two or more materials at specific mass flow rates to provide a desired mixing and composition formulation. The mixed composition is then sprayed or otherwise dispensed through a nozzle with multiple spray options. In some embodiments, the disclosed device may be one-time use and disposable, while in other embodiments the device may be reconditioned or field replaceable.

Referring now to the figures, FIGS. 1-6 illustrate an embodiment of a decontamination device 100. Referring first to FIGS. 1-4, the decontamination device 100 may include an outer casing 102 that forms a handle portion 104, a body portion 108, and a nozzle portion 110. The body portion 108 may include a bottom portion 107, a top portion 109, a front portion 111, and a rear portion 113. The handle portion 104 may include a front handle arm 112 that extends from the top portion 109 of the body portion 108 proximate the front portion 111, and a rear handle arm 114 that extends away from the top portion proximate the rear portion 113, and a hand grip 105 extending between distal ends of the front and rear handle arms. A handle gap 116 may be formed in a space between the top portion 109 of the body portion 108, the front handle arm 112, the rear handle arm 114, and the hand grip 105. In the illustrated embodiment, a trigger 106 may be disposed on the hand grip 105 proximate the front arm 112 so as to be accessible via the handle gap 116 by a user holding the device 100 by the hand grip. Upon activation, the trigger 106 may be depressed into the hand grip 105. It should be understood, however, that the trigger 106 may be disposed in different configurations in other embodiments.

Figure 6:
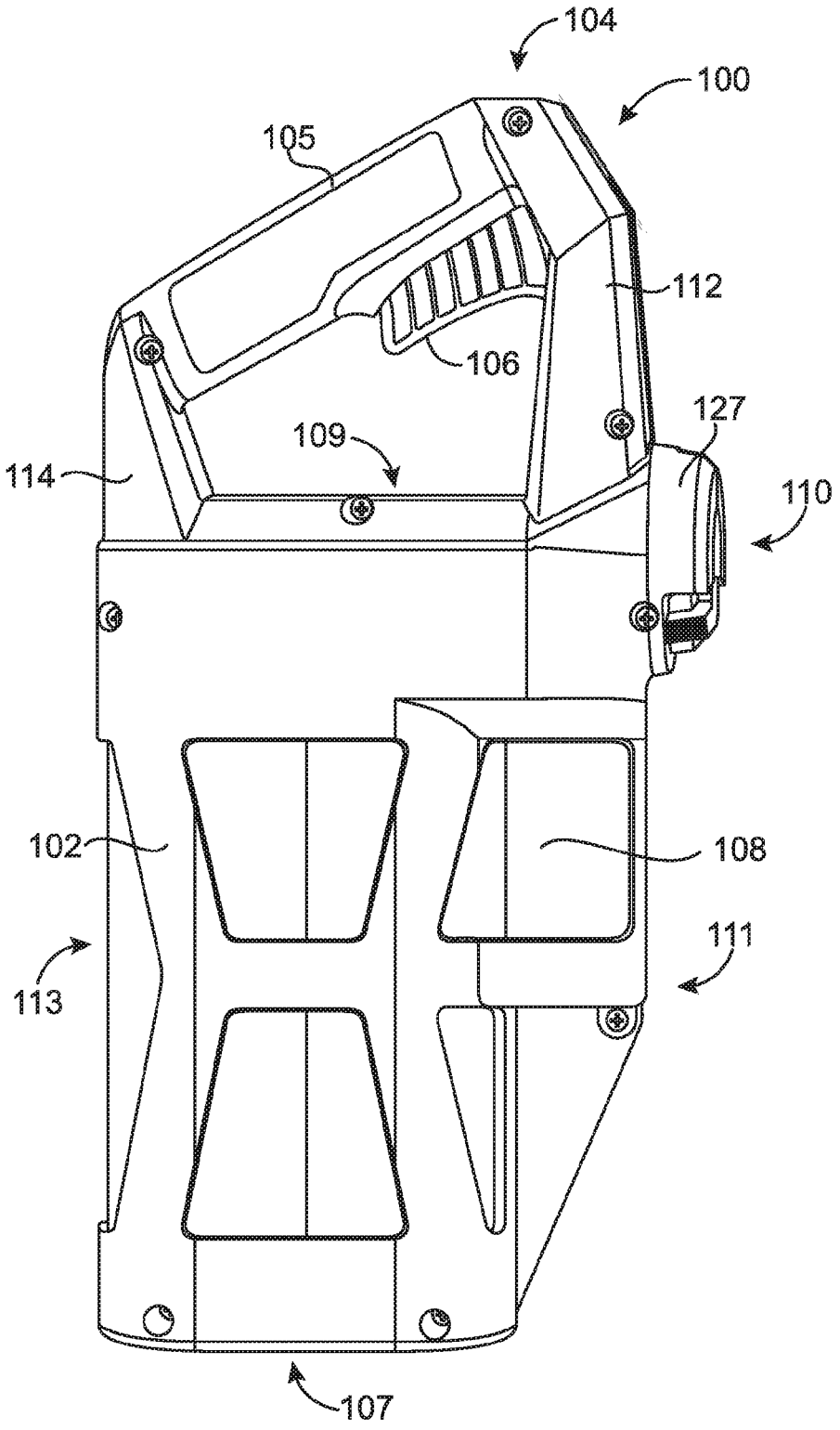
FIG. 6 shows a left side view of the decontamination device of FIG. 1 with a pull safety removed.

In the embodiment illustrated in FIGS. 1-4, the nozzle portion 110 may be disposed on the front portion 111 of the body portion 108 proximate the top portion 109. The nozzle portion 110 may include a removable pull safety 118 disposed so as to at least temporarily occlude a final nozzle 120 (visible in FIG. 5). The pull safety 118 and its engagement with the device 100 may best be appreciated by comparing FIG. 1, which shows an embodiment of the device with the pull safety in place, and FIG. 5, which shows an embodiment of the device with the pull safety removed. The pull safety 118 may include a pull tab 122, a central cover 124, and a tail 126. When in place on the nozzle portion 110, the central cover 124 may engage a nozzle face 125 and fit within a nozzle ring 127 to occlude the final nozzle 120. In some embodiments, the central cover 124 may have at least a slight interference fit with the nozzle ring 127 such that the pull safety stays in place until pulled by a user. In some embodiments, the tail 126 may fit within a tail slot 128 formed in the front handle arm 112. A tip orifice 130 may also be formed into the front handle arm 112 at an end of the tail slot 128 spaced away from the nozzle portion 110. In some embodiments, a tail tip 132 may fit into the tip orifice 130, as discussed in greater detail below. In one embodiment of the device 100, the pull safety 118 may be removed by a user prior to dispensing fluid from the device by pulling the pull tab 122 away from the nozzle portion 110. FIG. 6 shows another view of the device 100 with the pull safety 118 removed. In some embodiments, the pull safety 118 may include a tamper-evident system for removal. For example, fingers or attachments connected to the pull safety may help removably secure the pull safety 118 to the device 100. Upon removing the pull safety 118 from the nozzle portion 110, the fingers may become deformed, making it difficult or impossible to replace the pull safety onto the nozzle portion. This system may prevent a pull safety 118 from being replaced onto a device that has been used and, thus, does not hold a full supply of material in its canisters. One exemplary embodiment of such a system is illustrated with reference to FIG. 17, below. Other safety embodiments as alternatives to the illustrated pull safety are also contemplated herein. For example, some embodiments may include a pin inserted into one or multiple locations on the device 100 that may mechanically or otherwise prevent or limit the motion of the trigger 106, the cam component 162, the mixing manifold 146, or other components, the result of which may be to prevent mixing or dispensing of the material.

Figure 7:
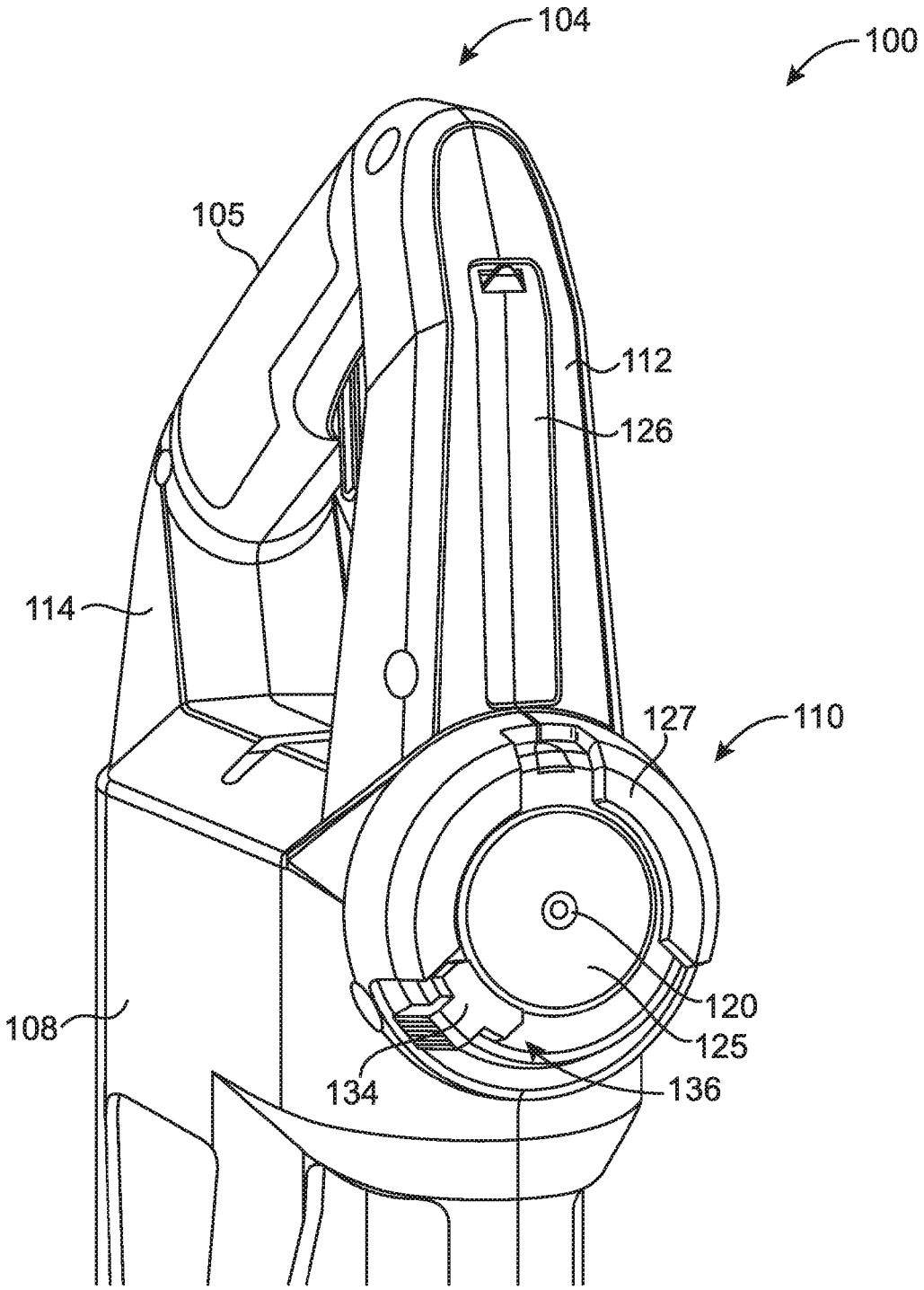
FIG. 7 shows an enlarged view of a nozzle portion of the decontamination device of FIG. 1 with the pull safety removed and a spray selector switch in a first position.
Figure 8:
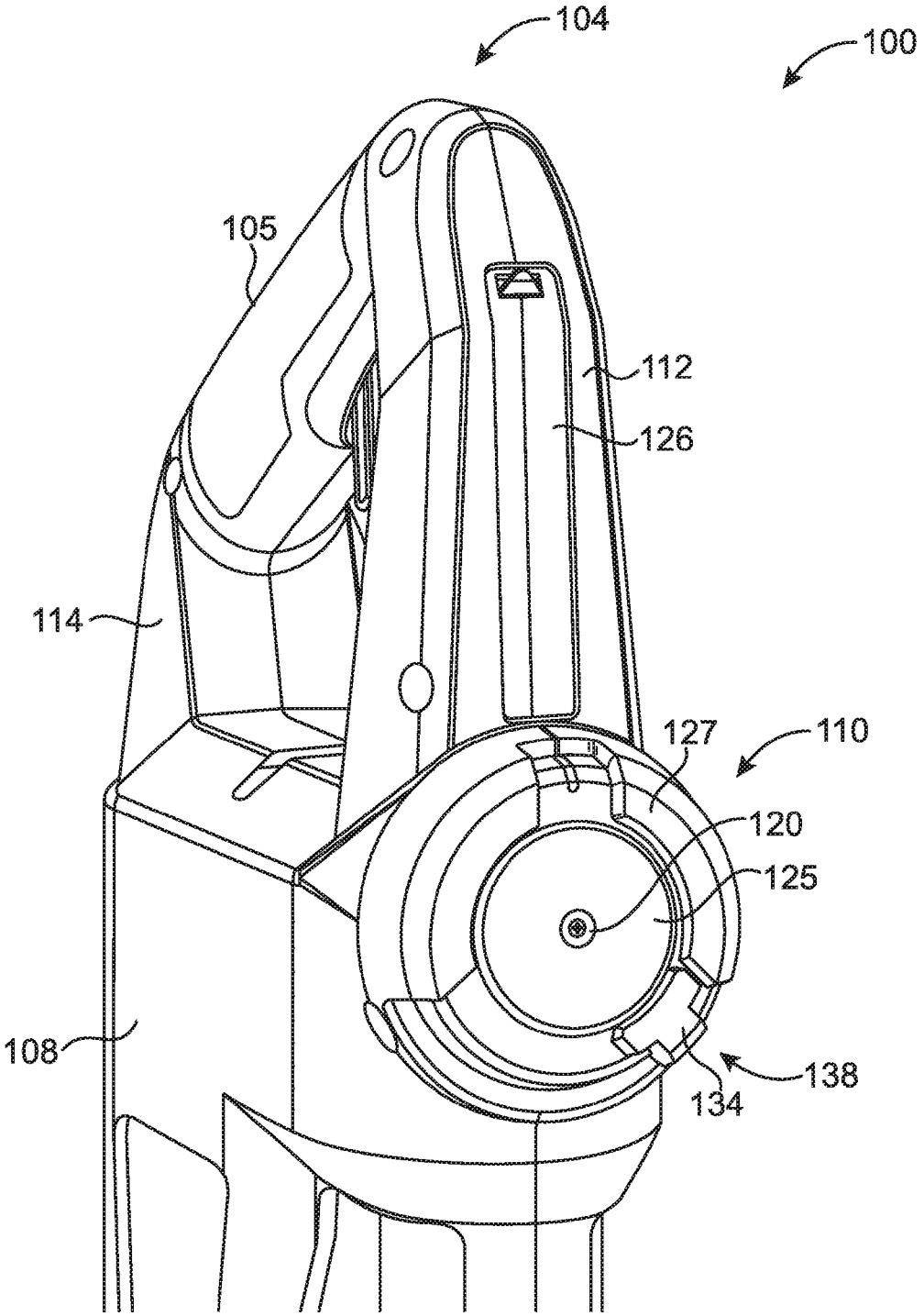
FIG. 8 shows an enlarged view of a nozzle portion of the decontamination device of FIG. 1 with the pull safety removed and a spray selector switch in a second position.

FIG. 7 and FIG. 8 illustrate an embodiment of the device 100 with a spray selector switch 134 formed on the nozzle face 125 that may be moved between a first position 136 (shown in FIG. 7) and a second position 138 (shown in FIG. 8). As shown in FIGS. 7 and 8, the nozzle portion 110 may include the nozzle ring 127 at least partially surrounding the nozzle face 125, and the final nozzle 120 formed through the nozzle face. The spray selector switch 134 may be disposed between two ends of the nozzle ring 127. In some embodiments, the nozzle face 125 may be rotated with respect to the nozzle ring 127 such that the nozzle face rotates when the spray selector switch 134 is moved from the first position 136 to the second position 138. In such embodiments, when the spray selector switch 134 is moved, the shape or flow of spray as fluids are dispensed through the final nozzle 120 may be changed. For example, in some embodiments, a first spray pattern may result from the spray selector switch 134 being in the first position 136 as shown in FIG. 7, and a second spray pattern may result from the spray selector switch being in the second position 138 as shown in FIG. 7. Examples of the type of spray patterns that could result from either the first position or the second position of the spray selector switch include, but are not limited to, course wet cone, course wet vertical spray, course wet horizontal spray, wide stream, straight stream, or other configurations that allow for customized spray coverage. Further, although the embodiment illustrated in FIGS. 7 and 8 shows two spray selector switch positions, it is contemplated herein that the spray selector switch could have any number of positions to indicate any number of spray patterns selectable by the user. It is also contemplated that, in some embodiments, the spray selector switch may not be affixed to the nozzle face, but may instead move along the nozzle face and cause other components within the nozzle portion to move and affect the spray shape.

Figure 9:
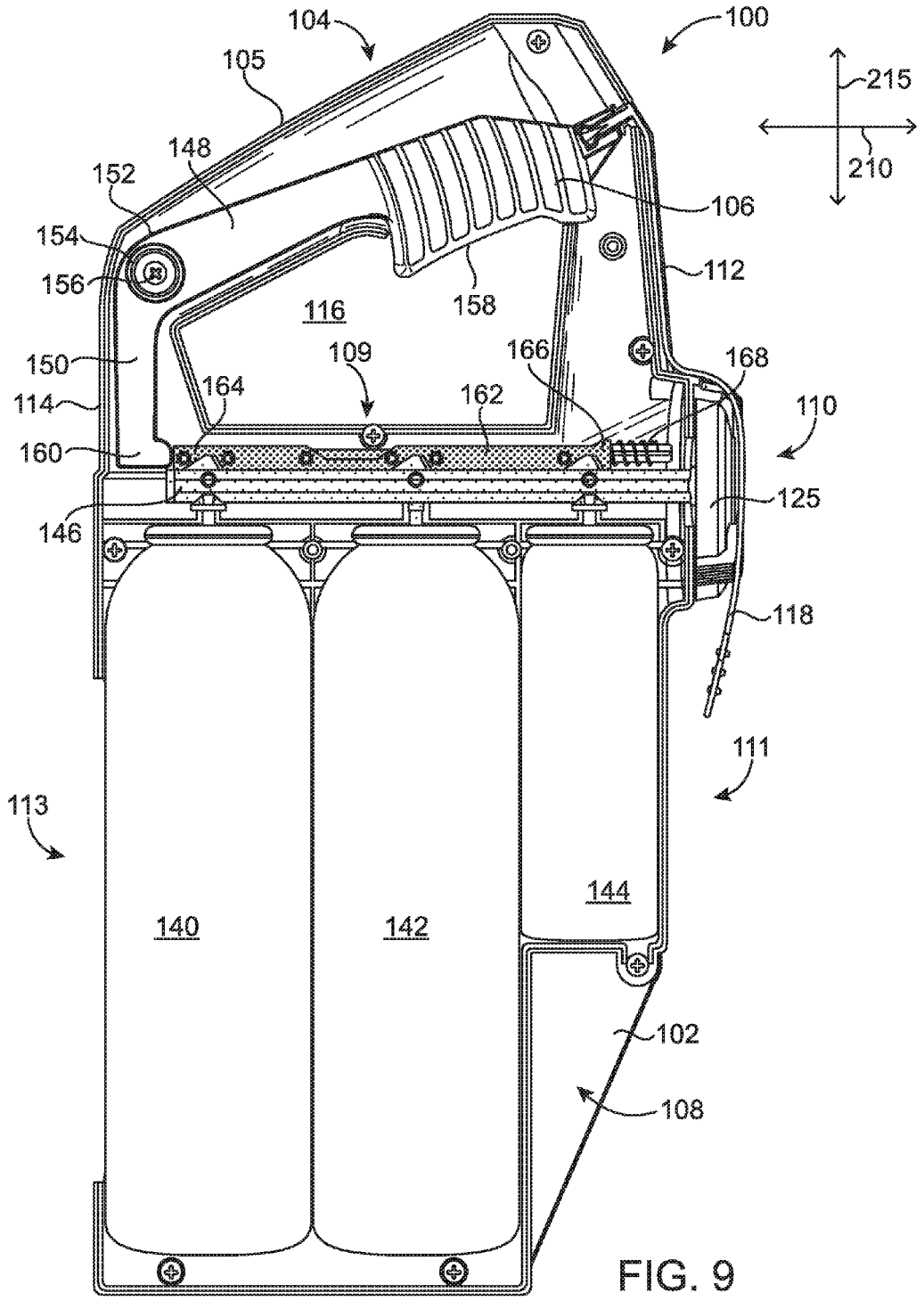
FIG. 9 shows a left side view of the decontamination device of FIG. 1 with a portion of an outer casing removed to show inner components of the device.
Figure 10:
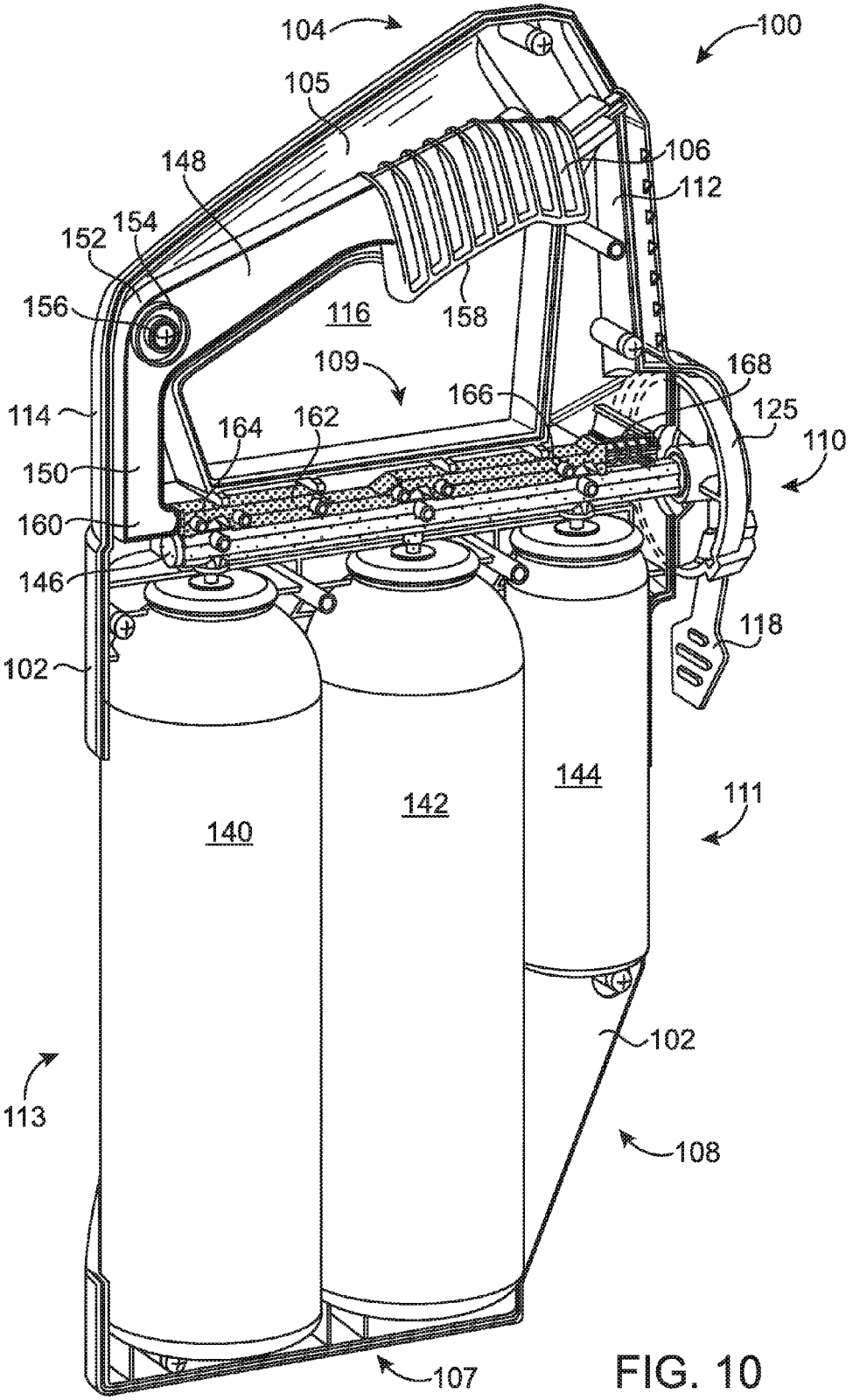
FIG. 10 shows a perspective view of the decontamination device of FIG. 1 with a portion of an outer casing removed to show inner components of the device.

FIGS. 9 and 10 illustrate an embodiment of the device 100 with a portion of the outer casing 102 removed to show components housed within the outer casing. In the embodiment illustrated in these figures, the body portion 108 houses a first canister 140, a second canister 142, and a third canister 144 within the outer casing 102. Although the embodiments illustrated herein show an embodiment of the device 100 holding three canisters, other embodiments with different numbers of canisters, such as two, or more than three, are also contemplated herein. Additionally, it is contemplated that the canisters may of various types in varying embodiments, such as, for example, aerosol, bag-on-valve, or other technology known to those skilled in the art. Alternatively, other dispensing designs or mechanisms may be employed in other embodiments. For example, some embodiments may include pre-loaded syringes, or inserting a desiccated and/or erodible material into the mixing manifold 146. In some embodiments, each canister 140, 142, 144 may be connected to a mixing manifold 146 that may be housed in the top portion 109 of the body portion 108. Generally, each canister 140, 142, 144 may hold materials in its interior to be mixed within the mixing manifold 146 and dispensed through the final nozzle 120 of the nozzle portion 110 upon activation of the trigger 106. The material held within the interior of each canister may vary depending on the embodiment and depending on the desired application. Some non-exhaustive examples of materials that may be held within the canisters are quaternary ammonium compounds, benzyl-C12-C16 alkyl di-methyl chlorides, liquid hydrogen peroxide, and diacetin. In some embodiments, one canister may hold water with quaternary ammonium compounds held at about 120 pounds per square inch (psi), another canister may hold a 7.99% solution of hydrogen peroxide, unstabilized, at about 120 psi, and another canister may hold food grade diacetin. Those of ordinary skill in the art, however, would understand that different combinations of different materials may be held within the canisters in different embodiments.

FIGS. 9 and 10 also illustrated other components of the trigger 106. Specifically, the trigger 106 may include a first trigger arm 148 housed substantially within the hand grip 105, and a second trigger arm 150 housed substantially within the rear handle arm 114. The first and second trigger arms 148, 150 may meet at a pivot portion 152, which may include a pivot orifice 154 for housing a pivot fastener 156. The pivot fastener 156 may be any kind of fastener suitable to fasten the trigger to the outer casing 102 through the pivot orifice 154, and to allow the trigger 106 to pivot about the pivot portion 152 around the pivot fastener 156. In some embodiments, the pivot fastener 156 may be integral to the outer casing 102 of the device 100. The trigger 106 may also include a trigger input 158 disposed at a distal end 149 of the first trigger arm 148 and a trigger output 160 disposed on the distal end of the second trigger arm 150. The trigger input 158 may extend out of the hand grip 105 into the handle gap 116 so as to be accessible to a user holding the device 100. When the user depresses the trigger input 158, the trigger 106 may pivot about the pivot fastener 156, thereby converting the trigger's substantially vertical motion into substantially horizontal or lateral motion of the trigger output 160.

Although the embodiment illustrated in FIGS. 9 and 10 includes a pivoting trigger, other contemplated embodiments may include linkages acting as cams, or a cable and pulley system, which themselves may take the form of many configurations. Additionally, the effect of the trigger on spray duration may vary in different embodiments, or combinations of different embodiments. For example, in some embodiments, the device 100 may be configured so as to mix and dispense material only when the trigger 106 is actively depressed, and stop dispensing when a user releases the trigger. In other embodiments, the device 100 may be configured to begin mixing and dispensing upon trigger 106 activation, and continue to mix and dispense until the canisters are empty regardless of whether the trigger remains depressed. In other embodiments, the trigger 106 may include a spray lock that may lock the trigger in the depressed position.

Figure 15:
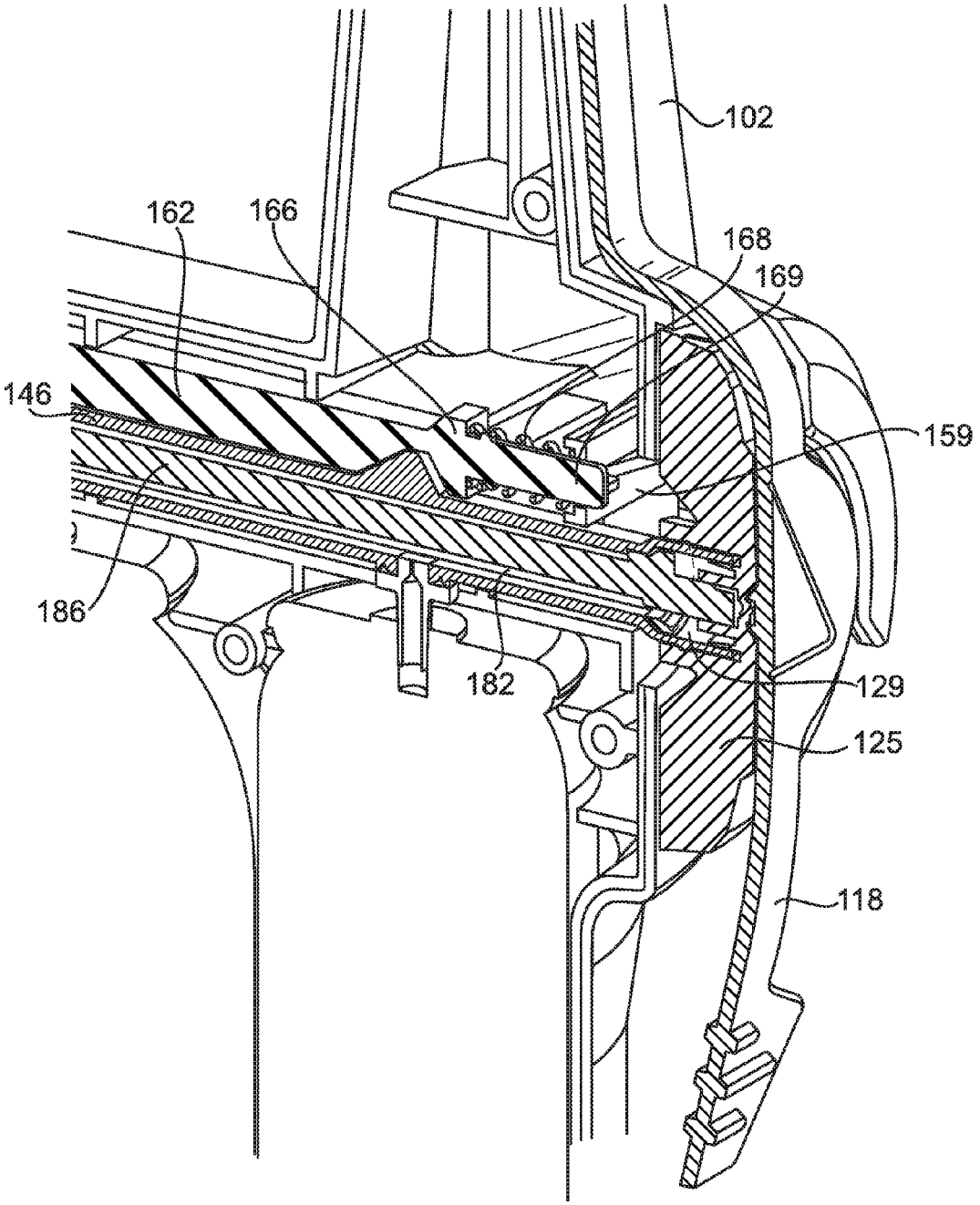
FIG. 15 shows an enlarged partial sectional view of the decontamination device of FIG. 1.

In some embodiments, the top portion 109 of the body portion 108 may additionally house a cam component 162 that may engage with the mixing manifold 146. The cam component 162 may have a trigger end 164 and a spring end 166 opposite the trigger end. The cam component 162 may be movable along a first axis 210, which in some embodiments may be a substantially horizontal or lateral direction with respect to the mixing manifold 146 between the trigger output 160 and the nozzle portion 110. In some embodiments, a spring 168 may engage with the cam component 162 to bias the cam component away from the nozzle portion 110 and toward the trigger output 160. In some embodiments, and as shown in FIG. 15, the spring end 166 of the cam component 162 may concentrically surround a component rod 169 of the cam component. The spring 168 may press against a biasing stem 159 that may be anchored to the outer casing 102. Thus, when a user depresses the trigger input 158, the trigger output 160 may move substantially along a first axis 210, which may be substantially horizontally in some embodiments, against the trigger end 164 of the cam component 162. If the trigger input 158 is depressed with enough force to overcome the biasing force of the spring 168, the cam component 162 may move with respect to the mixing manifold 146 in a direction toward the nozzle portion 110. Additionally, in some embodiments, the trigger may be configured to be a palm squeeze configuration where, for example, a user's palm may press against the trigger to activate the mechanism that activates the canisters. In another embodiment, the trigger may be a thumb depress configuration that may utilize an internal mechanism to activate the canisters.

Figure 11:
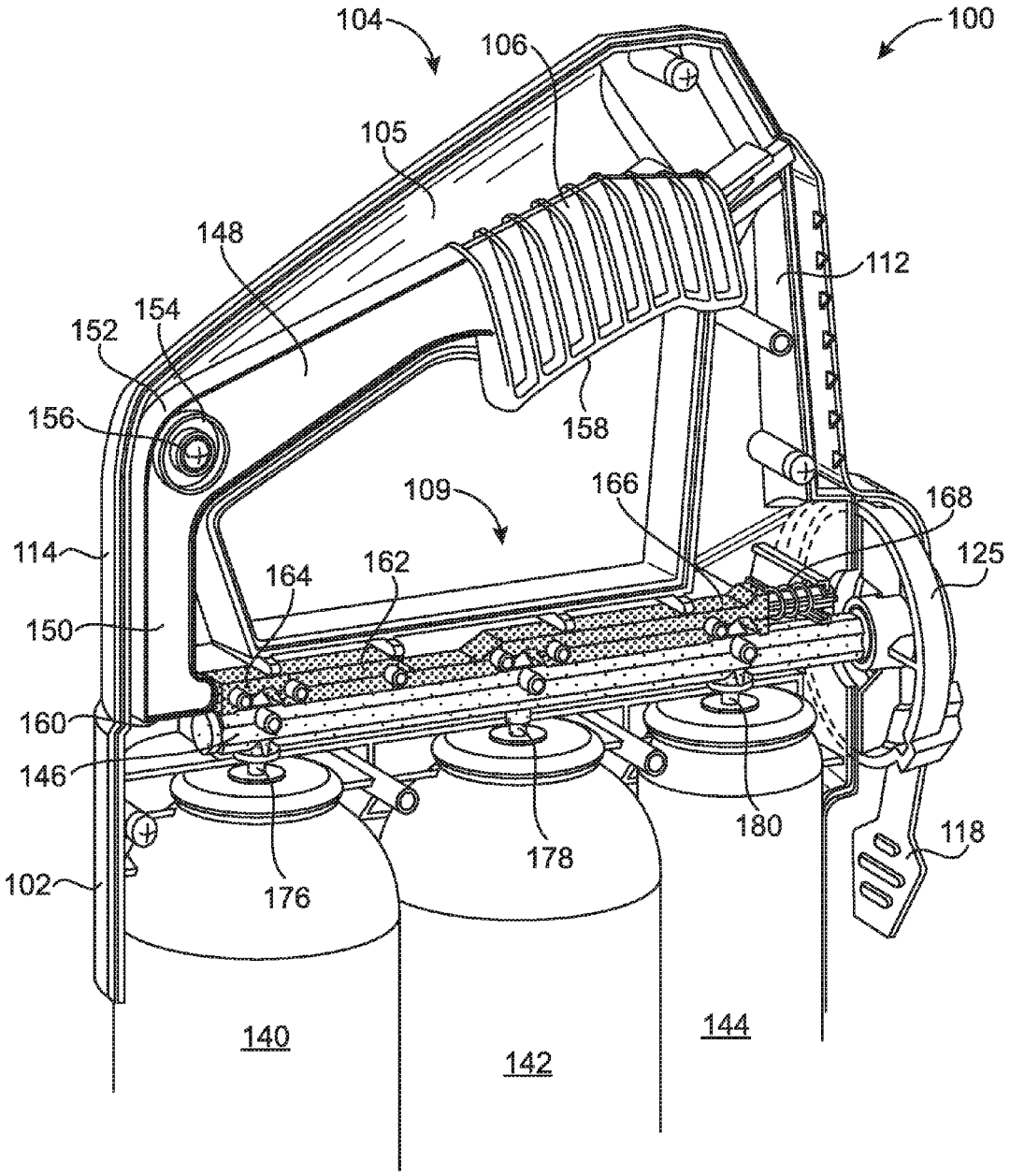
FIG. 11 shows an enlarged perspective view of the decontamination device of FIG. 1 with a portion of an outer casing removed to show inner components of the device.
Figure 12:
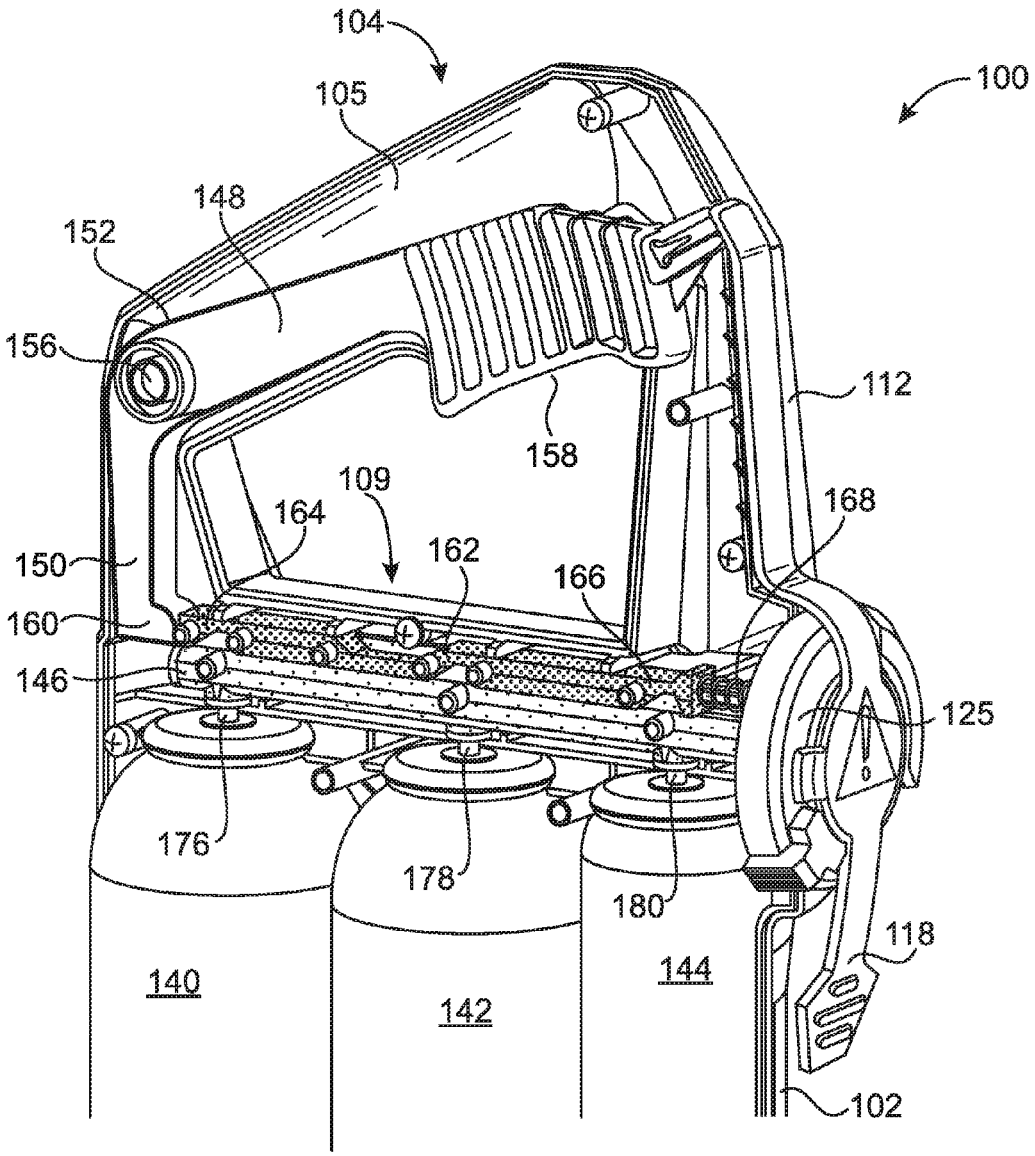
FIG. 12 shows another enlarged perspective view of the decontamination device of FIG. 1 with a portion of an outer casing removed to show inner components of the device.
Figure 13:
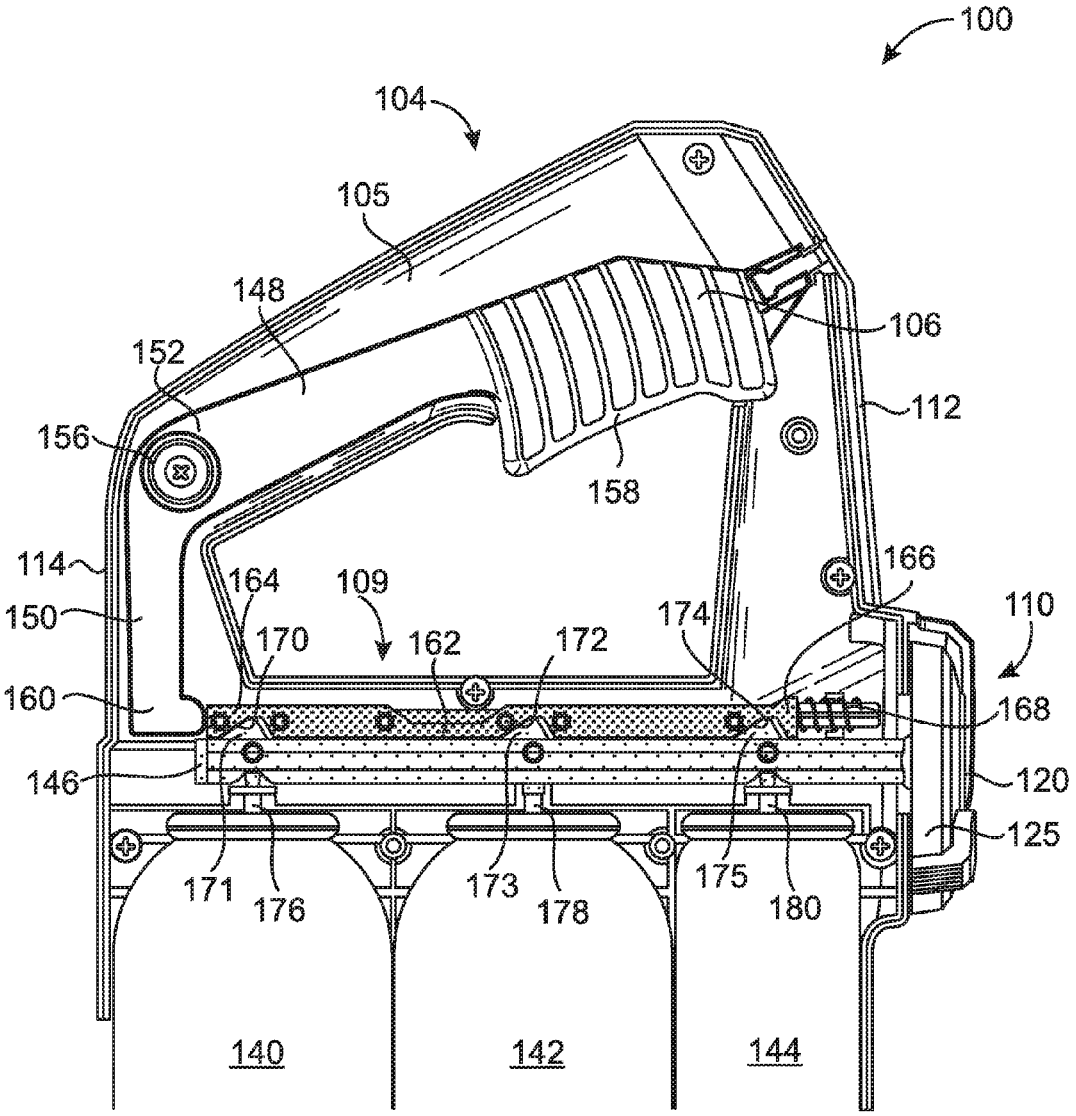
FIG. 13 shows an enlarged left side view of the decontamination device of FIG. 1 with a portion of an outer casing removed to show inner components of the device.

FIGS. 11-13 show a magnified view of an embodiment of the handle portion 104 and the top portion 109 of the body portion 108 with portions of the outer casing 102 removed for the sake of clarity. Referring first to FIG. 13, the cam component 162 and the mixing manifold 146 may be oriented with respect to one another such that at least one cam surface may translate the cam component movement along the first axis 210 into movement of the mixing manifold along a second axis 215 that, in some embodiments but not all, may be substantially perpendicular to the first axis. In some embodiments, the first axis 210 may be a substantially horizontal axis and the second axis 215 may be a substantially vertical axis. In such embodiments, the substantially horizontal motion of the cam component may be converted into substantially vertical motion of the mixing manifold. Specifically, in some embodiments, the cam component 162 may have a first cam surface 170, a second cam surface 172, and a third cam surface 174, and the mixing manifold 146 may have a first follower 171, second follower 173, and a third follower 175 that may engage with the first, second, and third cam surfaces, respectively. As the trigger output 160 pushes the cam component 162 toward the nozzle portion 110, the cam surfaces 170, 172, 174 may slide against the first, second, and third followers 171, 173, 175, respectively. As the mixing manifold 146 is substantially limited or restricted from horizontal movement, the movement of the cam surfaces against the followers of the mixing manifold exerts a vertically downward force on the mixing manifold. As a result, the mixing manifold 146 may move from a passive position vertically downward toward the canisters 140, 142, 144 into a dispensing position. The cam and follower relationship between the cam component 162 and the mixing manifold 146 is also shown in section in FIG. 14. Although the embodiment illustrated herein shows three respective cam surface and followers, embodiments of the cam component and mixing manifold having more or fewer respective cam surface and followers. In some embodiments, the number of cam surface and corresponding followers may correspond to the number of canisters used in a particularly device. For example, a device housing two canisters may include a cam component having two cams and a mixing manifold having two corresponding followers. Additionally, in some embodiments, the cam component may be integrated into the trigger itself.

Figure 14:
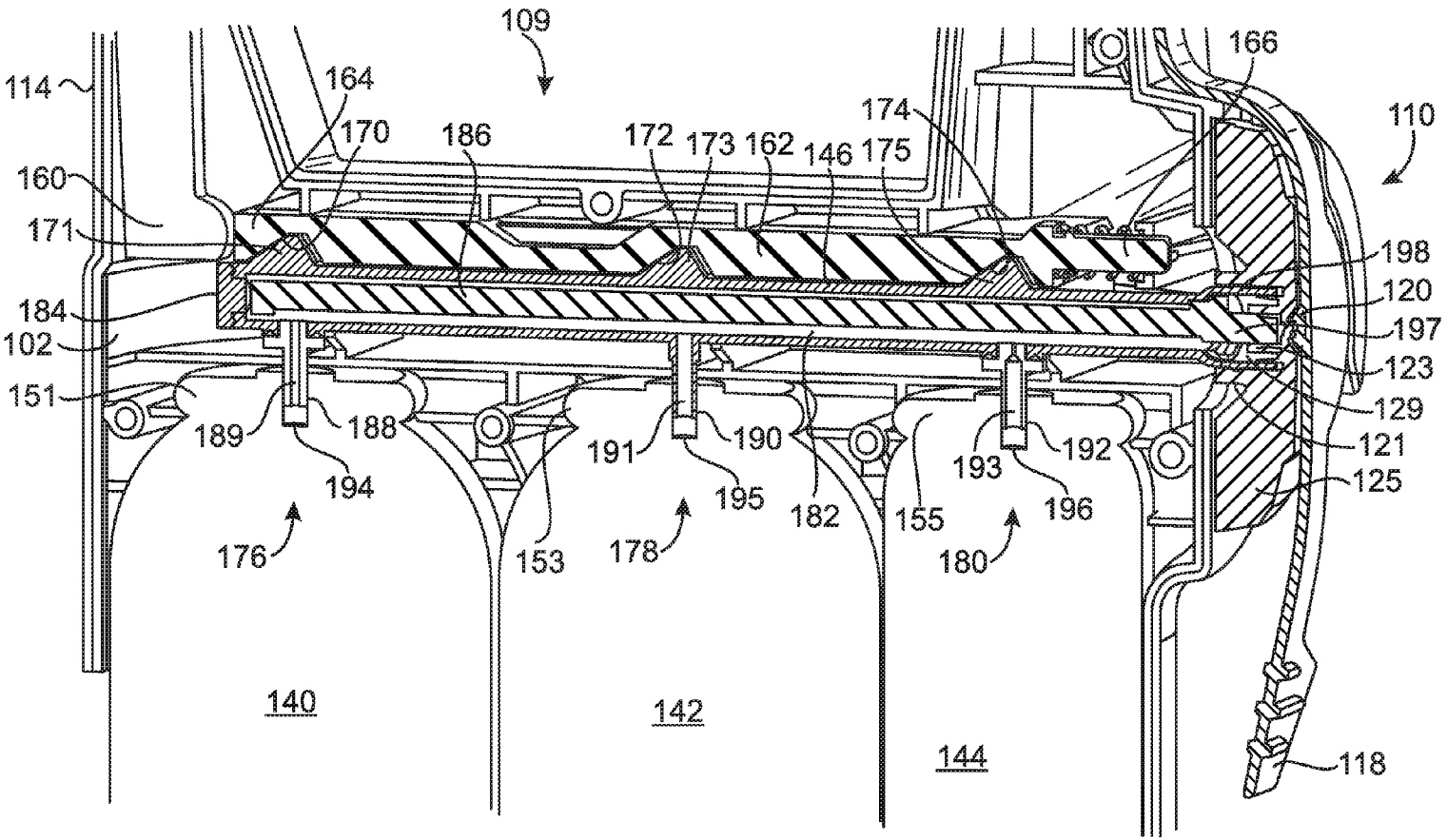
FIG. 14 shows a partial sectional view of the decontamination device of FIG. 1.

In some embodiments, the vertically downward motion of the mixing manifold 146 may open each of a first valve 176, a second valve 178, and a third valve 180 between the first, second, and third canisters 140, 142, 144, respectively, releasing the canisters' contents into the mixing manifold. The interaction between the canisters 140, 142, 144, their respective valves 176, 178, 180, and the mixing manifold 146 is best illustrated in FIG. 14. FIG. 14 illustrates a cross-sectional view of an embodiment of the device 100 with focus on the top portion 109, and interaction of the valves, the canisters, and the mixing manifold. The embodiment illustrated in FIG. 14 includes different types of valves for the first, second, and third valves 176, 178, 180. In this embodiment, each valve 176, 178, 180 may include a direct connection to the mixing manifold 146 with an integrated nozzle in the manifold. It is contemplated, however, that other types of connections may be used in other embodiments. For example, the connection between the canisters 140, 142, 144 and the mixing manifold 146 may include a male nozzle on the top of a canister that may be pressed into a gland or wiper seal on the mixing manifold, or the male nozzle may be pressed into a receiving cone on the mixing manifold, or other connections known to one skilled in the art.

In the embodiment in FIG. 14, the mixing manifold 146 may be substantially hollow so as to form a mixing chamber 182 within the mixing manifold. The mixing chamber 182 may run substantially the entire length of the mixing manifold 146, from the nozzle portion 110 to a chamber cap 184 opposite the nozzle portion that seals off the mixing chamber. Additionally, a chamber insert 186 may be disposed within the mixing chamber 182 so as to be substantially surrounded by the mixing manifold 146. The size and shape of the chamber insert 186 may influence the volume and flow patterns within the mixing chamber 182. For example, a relatively large chamber insert may result in relatively small mixing chamber volume, and a relatively small chamber insert may result in a relatively large mixing chamber volume. The size and shape of the mixing chamber 182 may affect the flow pattern and mixing quality of the multiple materials of the canisters 140, 142, 144 as they pass through the mixing chamber and eventually out the nozzle portion 110.

In the embodiment illustrated in FIG. 14, each of the first, second, and third valves 176, 178, 180 has a stem portion and a valve bore formed through the stem portion that may provide fluid communication between each respective canister 140, 142, 144 and the mixing chamber 182 when the valves are in an open position. Specifically, when the trigger 106 is activated, causing the trigger output 160 to move the cam component 162 horizontally and press the cam surfaces 170, 172, 174 against the followers 171, 173, 175, the mixing manifold 146 is pressed vertically downward. The downward vertical movement of the mixing manifold 146 results in the valve stem portions moving downward and simultaneously moving the valves 176, 178, 180 into an open position. When all the valves 176, 178, 180 are simultaneously moved into an open position, the contents of the canisters 140, 142, 144 may enter the mixing chamber 182 at substantially the same time allowing for mixing.

The first, second, and third canisters 140, 142, 144 may be disposed within the outer casing 102 of the device 100 and arranged such that an upper portion of the canisters may engage with the respective valves. Specifically, an upper portion 151 of the first canister 140 may be disposed so as to engage the first valve 176, an upper portion of the second canister 142 may be disposed so as to engage the second valve 178, and the third canister 144 may be disposed so as to engage the third valve 180. The first valve 176 may have a first stem portion 188 with a first valve bore 189 formed through the first stem portion that may provide fluid communication between the first canister 140 and the mixing chamber 182. The second valve 178 may have a second stem portion 190 with a second valve bore 191 formed through the second stem portion that may provide fluid communication between the second canister 142 and the mixing chamber 182. The third valve 180 may have a third stem portion 192 with a third valve bore 193 formed through the third stem portion that may provide fluid communication between the third canister 140 and the mixing chamber 182. In some embodiments, the upper portions 151, 153, 155 of each respective canister 140, 142, 144 may form a valve orifice 194, 195, 196 or other accommodation to accept or otherwise engage each respective valve 176, 178, 180.

The dimensions of each valve bore may vary between valves and depending on the desired mixture quality. For example, in the embodiment shown in FIG. 14, the first valve bore 189 formed through the first stem portion 188 may be relatively narrower as compared to the second valve bore 191 formed through the second stem portion 190. Such a relationship may be desired in embodiments where the mixture to be dispensed by the device 100 has a higher volume of a material stored in the second canister 142 than the material stored in the first canister 140. As an additional example, the third valve 180 shown in FIG. 14 may include a restrictor orifice as the third valve bore 193 formed through the third stem portion 192 narrows near the mixing chamber 182. It should be understood, however, that any of these types of valve bores and other types may be used in any combination to affect the mixture being dispensed from the device 100. It should also be understood that other types of device components may be used to control the proportions of material entering the mixing chamber 182 from the canisters and the amount of material flowing out of the final nozzle 120. For example, other embodiments may include induced vortexes, pressure adjusted orifices, resistance force orifices, etc. Such components and the features described herein may increase control of the proportions of the mixed materials from either a mass or volume basis, because in some embodiments, the dispensed material may rely on tight control of mix percentage.

FIG. 14 also shows the relationship between the mixing manifold 146, the chamber insert 186, and the nozzle face 125. A nozzle end 197 of the chamber insert 186 and a nozzle end 198 of the mixing manifold 146 may engage with the nozzle face 125, forming a flow path between the mixing chamber 182 and the final nozzle 120. The nozzle face 125 may include a substantially cylindrical outer nozzle collar 121 that may accept the nozzle end 198 of the mixing manifold 146. The nozzle face 125 may also include an inner nozzle collar 123 that is substantially concentric with the outer nozzle collar 121 that may accept the nozzle end 197 of the chamber insert 186. In the embodiment shown in FIG. 14, a mixing space 129 may be formed within the outer nozzle collar 121 and the nozzle end 198 of the mixing manifold 146 that may be in fluid communication with the mixing chamber 182. Additionally, although the inner nozzle collar 123 may substantially surround the nozzle end 197 of the chamber insert 182, it should be understood that at least a portion of the inner nozzle collar may allow fluid communication between the mixing space 129 and the final nozzle 120. In some embodiments, however, the engagement between the nozzle end 197 of the chamber insert 186 and the inner nozzle collar 123 may at least somewhat restrict flow between the mixing space 129 and the final nozzle 120. Such restriction may, in some embodiments, allow for improved mixing to take place within the mixing space 129 as the materials released from the canisters 140, 142, 144 flow through the mixing chamber 182 and converge in the mixing space 129. In other words, to the extent that, in some embodiments, the material released from a canister nearest the nozzle portion 110 (e.g., the third canister 144) may reach the mixing space 129 before the material released from a canister further from the nozzle portion (e.g., the first or second canister 140, 142), the restrictive engagement between the nozzle end 197 of the chamber insert 186 and the inner nozzle collar 123 of the nozzle face 125 may slow dispersion of the materials so as to allow opportunity for more thorough mixing prior to ejection from the final nozzle 120. Another view of the relationship between the mixing manifold 146, the chamber insert 186, and the nozzle face 125 is also shown in FIG. 15 with the pull safety 118 in place over the nozzle face 125.

Thus, in the embodiment shown in FIGS. 14 and 15, the materials stored in the respective canisters 140, 142, 144 may be released into the mixing chamber 182, flow into the mixing space 129, and out through the final nozzle 120 as a mixture upon a user activating the trigger 106.

Figure 16:
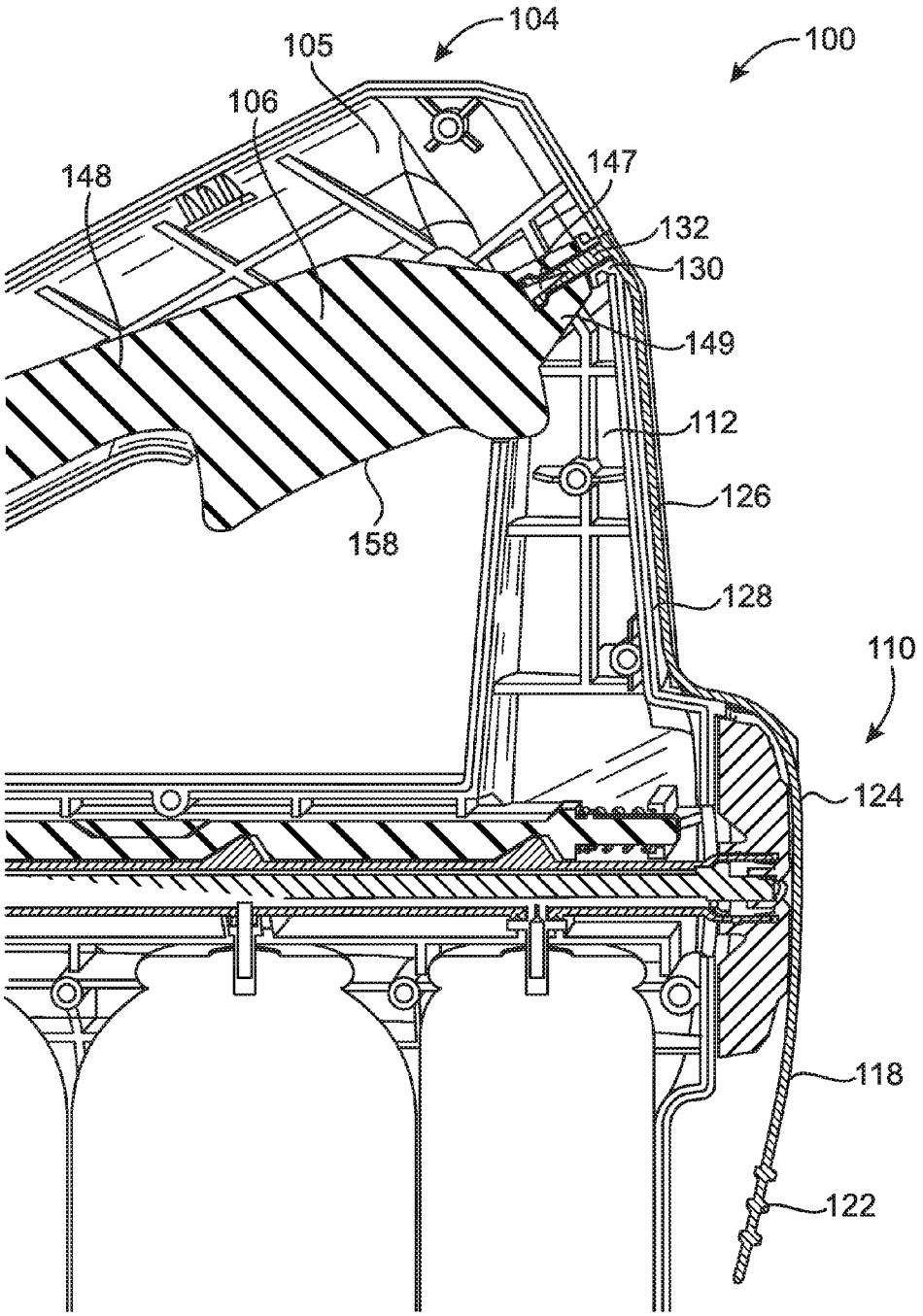
FIG. 16 shows another partial sectional view of the decontamination device of FIG. 1.
Figure 17:
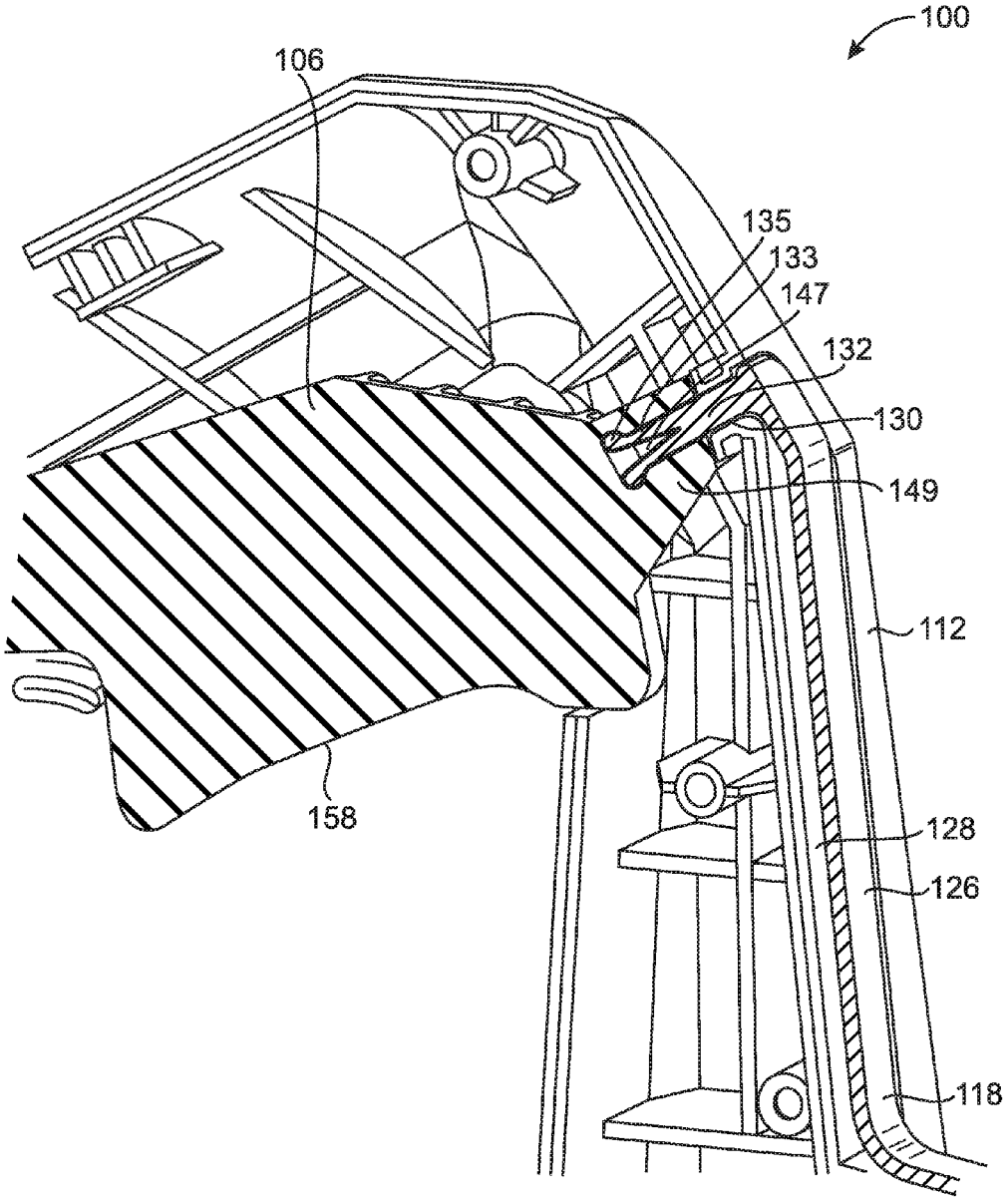
FIG. 17 shows another partial sectional view of the decontamination device of FIG. 1.

FIGS. 16 and 17 show the relationship between the pull safety 118 and the trigger 106. In some embodiments, the pull safety 118 may prevent activation of the trigger 106 while in place. Specifically, the tail 126 of the pull safety 118 may include a tail tip 132 that may fit through a tip orifice 130 formed in the front handle arm 112 to engage the distal end 149 of the first trigger arm 148. In some embodiments, a safety bore 147 may be formed into the distal end 149 of the first trigger arm 148 to accept the tail tip 132. In such embodiments, the tail tip 132 may prevent the first trigger arm 148 from moving when a user applies pressure to the trigger input 158. This safety mechanism may prevent accidental or inadvertent activation and dispensing of the materials stored within the device 100. When a user would like to use the device 100, however, the user may remove the pull safety 118, for example, by pulling on the pull tab 122. Pulling on the pull tab 122 may remove the central cover 124 from its position over the nozzle face 125 and may further remove the tail tip 132 from the safety bore 147 in the trigger. Such embodiments of the pull safety 118 and the trigger 106 may help prevent misfiring of the device because the pull safety may be configured such that the tail tip 132 may not be removable from the safety bore 147 and tip orifice 132 until the central cover 124 has already been pulled clear of the final nozzle 120. In other embodiments, however, it is contemplated that the tail tip 132 and central cover 124 may be removed individually.

In some embodiments, as shown best in FIG. 17, the tail tip 132 may include at least one finger 133, each of which may further include a finger protuberance 135. In such embodiments, the safety bore 147 may be formed relatively wider at toward its end than at its entrance so as to accommodate the finger protuberances 135 when the tail tip 132 is in place within the safety bore. A gap may be formed between fingers 133 such that when the tail tip 132 is removed from the safety bore, the sloped walls of the safety bore 147 are made to press against the protuberances 135, forcing the distal ends of the fingers 133 inward. This inward movement of the fingers 133 may allow the tail tip 132 to be removed from the safety bore 147 when a user pulls with sufficient force to overcome the fingers' tendency to resist inward movement. In some embodiments, once the tail tip 132 has been pulled fully clear of the safety bore 147, the elasticity of the fingers 133 may force the distal ends back into the originally expanded positions. In such embodiments, the fingers 133 may spread apart to a width that is greater than the width of the entrance to the safety bore 147, preventing or limiting the ability to re-insert the tip tail 132 into the safety bore. In such embodiments, a potential user of the device 100 may know that the device may not be full because the pull safety 118 has previously been removed. In some embodiments, the fingers 133 may not spring back into place, but instead be permanently deformed as they are removed from the safety bore 147. In such embodiments, the tip tail 132 may not be made to be secure within the safety bore 147 because the protuberances 135 may not press outwardly against the walls of the safety bore. Thus, in such embodiments, a potential user may also be alerted to the fact that the pull safety 118 has previously been removed and the canisters may not be full.

Figure 18:
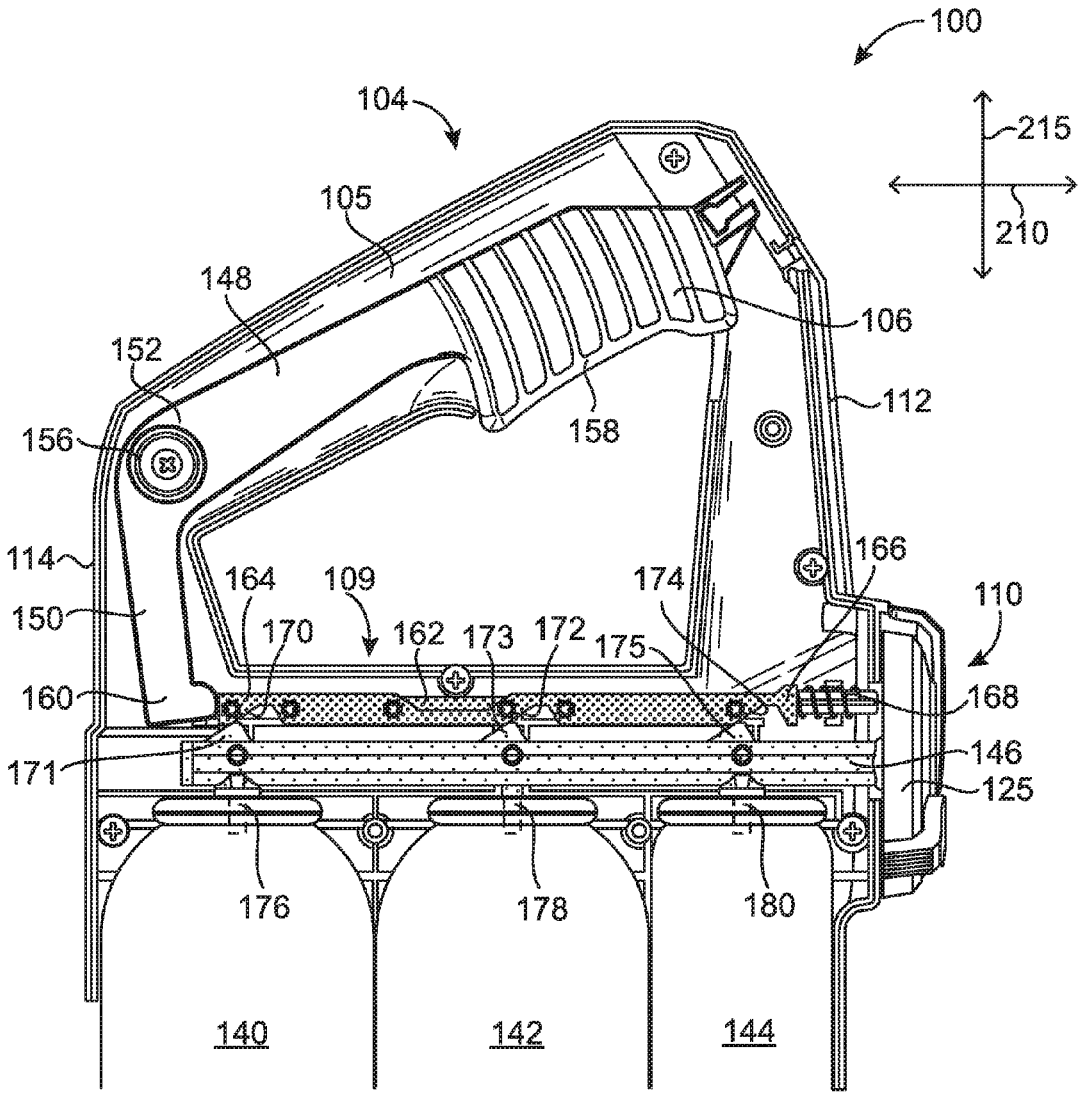
FIG. 18 shows another left side view of the decontamination device of FIG. 1 in a dispensing position with a portion of an outer casing removed to show inner components of the device.

FIG. 18 shows the device 100 in a dispensing position in which the trigger 106 has been moved from a passive position (e.g., FIG. 13), into a dispending position. As shown, the trigger output 160 may press against the trigger end 164 of the cam component 162, moving the cam component horizontally from a passive position toward the nozzle portion 110 into a dispensing position. As the cam component 162 moves toward the nozzle, the cam surfaces 170, 172, 174 may press downward on the first, second, and third followers 171, 173, 175, respectively, which may move the mixing manifold toward the canisters 140, 142, 144 from a passive position into a dispensing position. The mixing manifold's 146 downward movement may open the first, second, and third valves 176, 178, 180, allowing the material in the respective canisters 140, 142, 144 to enter the mixing manifold, mix, and be dispensed through the nozzle.

Figure 19:
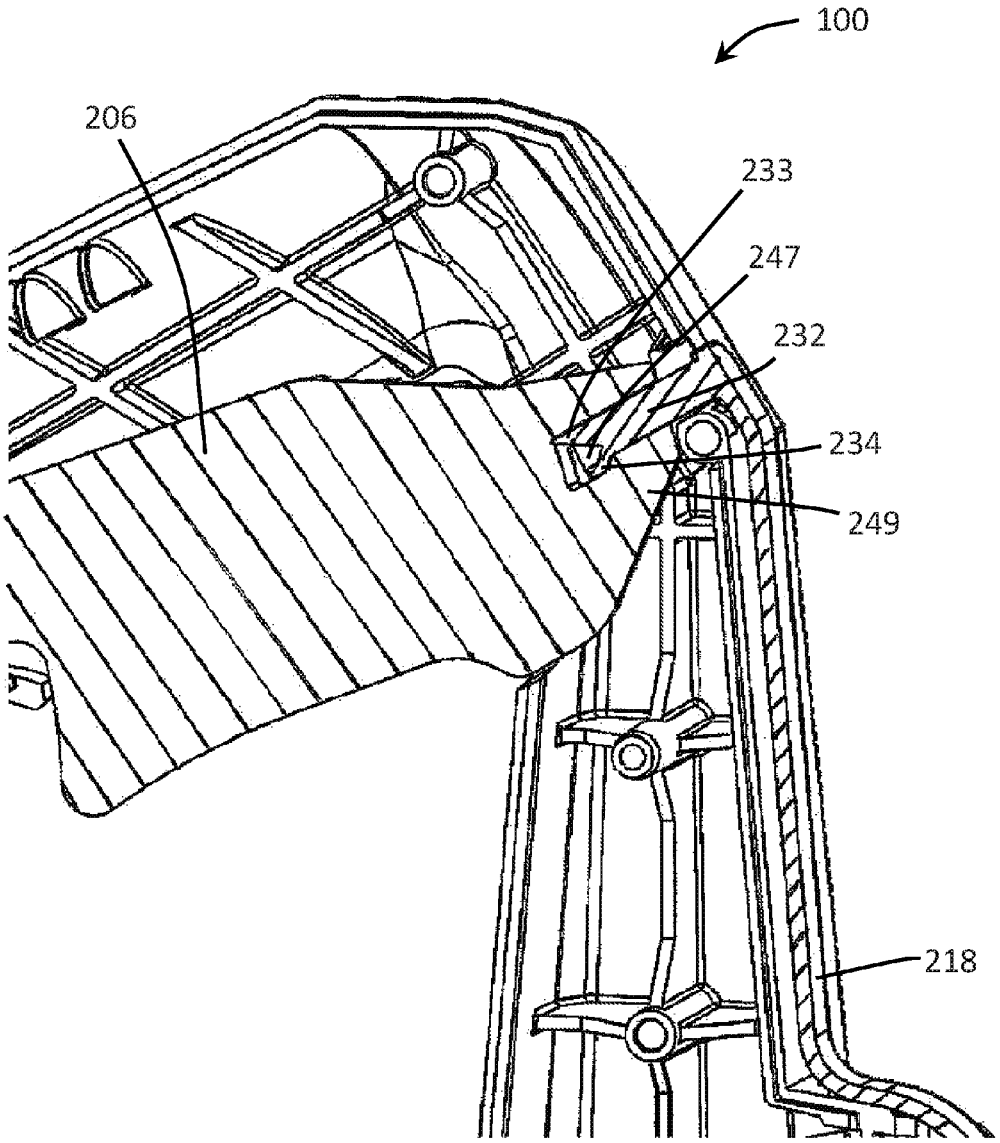
FIG. 19 shows a partial sectional view of an embodiment of a decontamination device showing an alternative embodiment of the pull safety.
Figure 20:
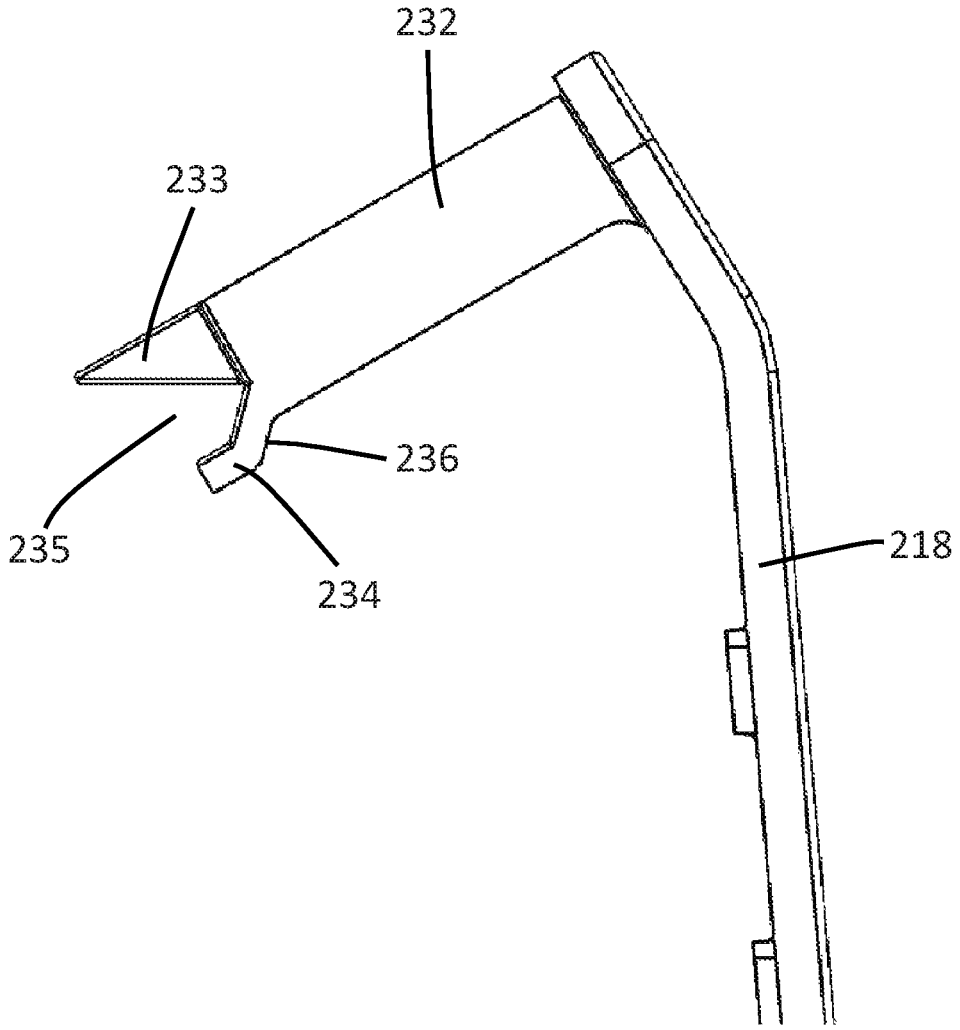
FIG. 20 shows a partial side view of a tail tip of the alternative embodiment of the pull safety shown in FIG. 19.

FIGS. 19 and 20 shows an alternative embodiment of a safety pull 218 that has a tail tip 232 that may be used with a trigger 206 forming a safety bore 247 at its distal end 249. In this embodiment, the tail tip 232 may include a first finger 233 and a second finger 234 with a gap 235 formed between the two fingers. The safety bore 247 may be formed relatively wider toward its end than at its entrance so as to house the first and second fingers 233, 234 when the tail tip 232 is in place within the safety bore. At least one of the first or second fingers 233, 234 may include a finger cam 236. In some embodiments, as the tail tip 232 is pulled out of the safety bore 247, pressure on the finger cam 236 from the walls of the safety bore may force the second finger 234 toward the first finger 233, narrowing the gap 235 when a user pulls with sufficient force to overcome the fingers' tendency to resist inward movement. In some embodiments, once the tail tip 232 has been pulled fully clear of the safety bore 247, the elasticity of the fingers 233, 234 may force the distal ends back into the originally expanded positions. In such embodiments, the fingers 233, 234 may spread apart to a width that is greater than the width of the entrance to the safety bore 247, preventing or limiting the ability to re-insert the tip tail 232 into the safety bore. In such embodiments, a potential user of the device 100 may know that the device may not be full because the pull safety 218 has previously been removed. In some embodiments, the fingers 233, 234 may not spring back into place, but instead be permanently deformed as they are removed from the safety bore 247. In such embodiments, the tip tail 232 may not be made to be secure within the safety bore 247 because the finger cam 236 and fingers 233, 234 may not press outwardly against the walls of the safety bore. Thus, in such embodiments, a potential user may also be alerted to the fact that the pull safety 218 has previously been removed and the canisters may not be full.

It will be understood by those skilled in the art that the device 100 described above may be of virtually any practical size and dimensions so long as it is capable of performing the described functions. Some embodiments of the device, however, may have contain a volume of material of about 14.5 oz. (about 430 mL), about 22 oz. (about 650 mL), or about 29.5 oz. (about 875 mL). The device may have a width of about 6.6 inches (about 167.5 mm), a depth of about 2.3 inches (about 59 mm), and a height of about 13 inches (about 330 mm). In other embodiments, the device may have a width of about 6.6 inches (about 167.5 mm), a depth of about 2.3 inches (about 59 mm), and a height of about 16.2 inches (about 412 mm). In other embodiments, the device may have a width of about 7.7 inches (about 196 mm), a depth of about 3 inches (about 76 mm), and a height of about 13.8 inches (about 350 mm).

Additionally, it will be understood that the disclosed device 100 may be used for a variety of different applications for which dispensing a mixture of materials may be desired. One possible application may be in decontamination of biologic agents, including, but not limited to, strains of *bacillus anthracis* like Ames-RIID and ANR-1, and *yersinia pestis* (e.g., ATCC 11953). Another application may be in decontamination of chemical agents, such as, but not limited to, mercury (Hg), GD nerve agents (i.e., pinacolyl methylphosphonofluoridate or 1,2,2-trimethylpropyl methylphosphonofluoridate), or VX nerve agents (i.e., O-ethyl S-(2-diisopropylaminoethyl) methylphosphonothiolate or methylphosphonothioic acid). Another application may be in decontamination of human excretions including, but not limited to, urine, vomit, feces, blood, and other bodily fluids. Although variable based on the type of contaminant and other conditions, in some embodiments the time to decontamination may be about 10 minutes after spraying. In some embodiments, the time to decontamination could be 10 seconds, or 20 seconds, or 20 minutes in yet other embodiments.

Although variable and dependent upon application, the following is an example of a method of using the device disclosed herein. Those of ordinary skill in the art will recognized that these steps may be performed in any practical order so as to dispense the mixture in a desired use. The user may identify a hazardous material or otherwise contaminated target. If the device is stored in a pouch or holder, the device may be removed. The user may check whether the pull safety is in place, and may determine not to use the device if the safety or central cover has been previously removed. The user may select a spray type as appropriate for the application. For example, in some embodiments, turning the spray selector to the left may result in a stream dispensing shape, and turning the spray selector to the right may result in a coarse wet spray shape, though other options may be available as well. The user may pull the pull tab to remove the pull safety and the central cover from the nozzle portion. The user may aim the nozzle portion at the contaminant or other hazardous material, and squeeze the trigger to activate the trigger mechanism and open the canister valves. In some embodiments, a full stream of dispensed spray may last about 40 seconds, or about 35 seconds in other embodiments. It should be understood, however, that time to dispense the spray may vary depending on how full the canisters are for a particular use, and on the pressure within the canisters. While dispensing, the user may sweep the spray across the hazardous material to coat it evenly. The user may start and stop spraying periodically. In some embodiments, a 14.5 oz. (430 mL) device may coat up to about 25 square feet (2.3 square meters). In some embodiments, a 10.6 oz. (315 mL) device may coat up to about 18 square feet (1.67 square meters). The user may wait at least 10 minutes, in some embodiments, for the hazardous material to be decontaminated, but other wait times may apply depending on the application.

The foregoing description and drawings merely explain and illustrate the invention and the invention is not limited thereto. While the specification is described in relation to certain implementation or embodiments, many details are set forth for the purpose of illustration. Thus, the foregoing merely illustrates the principles of the invention. For example, the invention may have other specific forms without departing from its spirit or essential characteristic. The described arrangements are illustrative and not restrictive. To those skilled in the art, the invention is susceptible to additional implementations or embodiments and certain of these details described in this application may be varied considerably without departing from the basic principles of the invention. It will thus be appreciated that those skilled in the art will be able to devise various arrangements which, although not explicitly described or shown herein, embody the principles of the invention and, thus, within its scope and spirit.

What is claimed is:

1. A mixing and dispensing device comprising:

an outer casing including a body portion, a handle portion, and a nozzle portion, wherein the handle portion is connected to a top portion of the body portion and the nozzle portion includes a nozzle;

a mixing manifold disposed in the top portion of the body portion, the mixing manifold including a mixing chamber in fluid communication with the nozzle;

a plurality of canisters disposed within the body portion, each of the plurality of canisters including a valve connected to the mixing manifold, the valve being movable between a valve passive position, in which the valve prevents fluid communication between an interior of the canister and the mixing chamber, and a valve dispensing position, in which the valve provides fluid communication between the interior of the canister and the mixing chamber;

a trigger including a trigger input and a trigger output, the trigger at least partially disposed within the handle portion, and wherein the trigger is configured to move from a trigger passive position to a trigger dispensing position causing the valve of each canister to move from the valve passive position to the valve dispensing position, wherein the trigger includes a safety bore; and a pull safety including a central cover and a tail tip, the pull safety removably disposed on the outer casing such that the central cover occludes the nozzle and the tail tip prevents movement of the trigger from the trigger passive position to the trigger dispensing position, wherein the tail tip is removably disposed in the safety bore, and a width of a distal end of the tail tip is greater than a width of an entrance to the safety bore.

2. The mixing and dispensing device of claim 1, wherein the distal end of the tail tip includes a first finger and a second finger with a gap formed between the first and second fingers disposed within the safety bore, the first and second fingers configured to expand to a width that is greater than the entrance to the safety bore when the first and second fingers are removed from the safety bore so as to prevent reinsertion of the tail tip into the safety bore.

3. The mixing and dispensing device of claim 1, wherein the handle portion of the outer casing forms a tip orifice that is substantially aligned with the safety bore when the trigger is in the trigger passive position so as to allow the tip tail to pass through the tip orifice and into the safety bore.

4. The mixing and dispensing device of claim 1, further comprising a cam component disposed in the top portion of the body portion, the cam component configured to convert movement of the trigger from the trigger passive position to the trigger dispensing position into movement of the mixing manifold from a mixing manifold passive position to a manifold dispensing position.

5. The mixing and dispensing device of claim 4, wherein movement of the mixing manifold from the mixing manifold passive position to the manifold dispensing position causes each valve of the plurality of canisters to move from the valve passive position to the valve dispensing position.

6. The mixing and dispensing device of claim 1, further comprising a cam component disposed in the top portion of the body portion, the cam component configured to be engaged by the trigger output to move the cam component along a first axis from a cam component passive position to a cam component dispensing position when the trigger moves from the trigger passive position to the trigger dispensing position.

7. The mixing and dispensing device of claim 6, wherein the mixing manifold is in communication with the cam component such that movement of the cam component along the first axis from the cam component passive position to the cam component dispensing position causes movement of the mixing manifold along a second axis from a manifold passive position to a manifold dispensing position.

8. The mixing and dispensing device of claim 7, wherein the first axis is substantially perpendicular to the second axis.

9. A mixing and dispensing device comprising:

an outer casing including a body portion, a handle portion, and a nozzle portion, wherein the handle portion is connected to a top portion of the body portion and the nozzle portion includes a nozzle;

a trigger including a trigger input and a trigger output, the trigger at least partially disposed within the handle portion, and wherein the trigger is configured to move between a trigger passive position and a trigger dispensing position;

a cam component disposed in the top portion of the body portion, the cam component configured to be engaged by the trigger output to move the cam component along a first axis from a cam component passive position to a cam component dispensing position when the trigger moves from the trigger passive position to the trigger dispensing position;

a mixing manifold disposed in the top portion of the body portion, the mixing manifold including a mixing chamber in fluid communication with the nozzle, and wherein the mixing manifold is in communication with the cam component such that movement of the cam component along the first axis from the cam component passive position to the cam component dispensing position causes movement of the mixing manifold along a second axis from a manifold passive position to a manifold dispensing position;

at least one canister disposed within the body portion, each of the at least one canister including a valve connected to the mixing manifold, the valve being movable between a valve passive position, in which the valve prevents fluid communication between an interior of the respective canister and the mixing chamber, and a valve dispensing position, in which the valve provides fluid communication between the interior of the respective canister and the mixing chamber; and a pull safety removably disposed on the outer casing includes a central cover and a tail tip such that the pull safety occludes the nozzle and prevents movement of the trigger from the trigger passive position to the trigger dispensing position, wherein the central cover of the pull safety is disposed over the nozzle and the tail tip of the pull safety is disposed in a safety bore of the trigger to prevent movement of the trigger, wherein the tail tip includes two fingers with at least one of the fingers including a finger cam;

wherein movement of the trigger from the trigger passive position to the trigger dispensing position results in fluid communication between the interior of the at least one canister, the mixing chamber, and the nozzle.

10. The mixing and dispensing device of claim 9, where the first axis is substantially perpendicular to the second axis.

11. The mixing and dispensing device of claim 9, further comprising a spring disposed in the top portion so as to bias the cam component toward the trigger output.

12. The mixing and dispensing device of claim 9, wherein the trigger is pivotally disposed within the handle portion such that movement of the trigger input substantially along the first axis results in movement of the trigger output substantially along the first axis.

13. The mixing and dispensing device of claim 9, wherein the handle portion of the outer casing forms a tip orifice that is substantially aligned with a safety bore of the trigger when the trigger is in the trigger passive position so as to allow the tail tip to pass through the tip orifice and into the safety bore.

14. A mixing and dispensing device comprising:

an outer casing including a body portion, a handle portion, and a nozzle portion, wherein the handle portion is connected to a top portion of the body portion and the nozzle portion includes a nozzle;

a trigger including a trigger input and a trigger output, the trigger at least partially disposed within the handle portion, and wherein the trigger is configured to move between a trigger passive position and a trigger dispensing position;

a cam component disposed in the top portion of the body portion, the cam component configured to be engaged by the trigger output to move the cam component along a first axis from a cam component passive position to a cam component dispensing position when the trigger moves from the trigger passive position to the trigger dispensing position;

a mixing manifold disposed in the top portion of the body portion, the mixing manifold including a mixing chamber in fluid communication with the nozzle, and wherein the mixing manifold is in communication with the cam component such that movement of the cam component along the first axis from the cam component passive position to the cam component dispensing position causes movement of the mixing manifold along a second axis from a manifold passive position to a manifold dispensing position;

at least one canister disposed within the body portion, each of the at least one canister including a valve connected to the mixing manifold, the valve being movable between a valve passive position, in which the valve prevents fluid communication between an interior of the respective canister and the mixing chamber, and a valve dispensing position, in which the valve provides fluid communication between the interior of the respective canister and the mixing chamber; and a pull safety removably disposed on the outer casing casing includes a central cover and a tail tip such that the pull safety occludes the nozzle and prevents movement of the trigger from the trigger passive position to the trigger dispensing position, wherein the central cover of the pull safety is disposed over the nozzle and the tail tip of the pull safety is removably disposed in a safety bore of the trigger to prevent movement of the trigger;

wherein movement of the trigger from the trigger passive position to the trigger dispensing position results in fluid communication between the interior of the at least one canister, the mixing chamber, and the nozzle;

wherein the handle portion of the outer casing forms a tip orifice that is substantially aligned with a safety bore of the trigger when the trigger is in the trigger passive position so as to allow the tail tip to pass through the tip orifice and into the safety bore.

15. The mixing and dispensing device of claim 14, where the first axis is substantially perpendicular to the second axis.

16. The mixing and dispensing device of claim 14, wherein the trigger is pivotally disposed within the handle portion such that movement of the trigger input substantially along the first axis results in movement of the trigger output substantially along the first axis.

* * * * *